US010121323B2

(12) United States Patent
Munakata et al.

(10) Patent No.: US 10,121,323 B2
(45) Date of Patent: Nov. 6, 2018

(54) GAMING MACHINE

(71) Applicants: Universal Entertainment Corporation, Tokyo (JP); Aruze Gaming (Hong Kong) Limited, Kowloon (HK)

(72) Inventors: Hiroki Munakata, Tokyo (JP); Tatsuya Teranishi, Tokyo (JP); Kensaku Yoshikawa, Tokyo (JP)

(73) Assignees: UNIVERSAL ENTERTAINMENT CORPORATION, Tokyo (JP); ARUZE GAMING (HONG KONG) LIMITED, Kowloon (HK)

( * ) Notice: Subject to any disclaimer, the term of this patent is extended or adjusted under 35 U.S.C. 154(b) by 0 days.

(21) Appl. No.: 15/487,528

(22) Filed: Apr. 14, 2017

(65) Prior Publication Data

US 2017/0330419 A1 Nov. 16, 2017

Related U.S. Application Data

(60) Provisional application No. 62/335,770, filed on May 13, 2016.

(51) Int. Cl.
*G07F 17/32* (2006.01)

(52) U.S. Cl.
CPC ..... *G07F 17/3258* (2013.01); *G07F 17/3227* (2013.01); *G07F 17/3262* (2013.01); *G07F 17/3267* (2013.01)

(58) Field of Classification Search
None
See application file for complete search history.

(56) References Cited

U.S. PATENT DOCUMENTS

| | | | | |
|---|---|---|---|---|
| 9,613,494 | B2 * | 4/2017 | Wolf | G07F 17/3258 |
| 2006/0030390 | A1 * | 2/2006 | Okada | G07F 17/32 463/16 |
| 2010/0120498 | A1 * | 5/2010 | Cuddy | G07F 17/3258 463/20 |
| 2010/0120499 | A1 * | 5/2010 | Cohen | G07F 17/3244 463/20 |
| 2011/0195772 | A1 * | 8/2011 | Gagner | G07F 17/32 463/27 |

* cited by examiner

*Primary Examiner* — Damon Pierce
(74) *Attorney, Agent, or Firm* — Lex IP Meister, PLLC

(57) ABSTRACT

A gaming machine comprises a terminal device which runs a game, and a storage device which stores a point value generated in games run in the terminal device and a game play count. The gaming machine stores, in a game play count storage area, a total game play count incremented in each game; accumulatively stores a portion of a total point value in a first storage area; accumulatively stores the remaining portion of the total point value in a second storage area of the storage device; adds the point value stored in the first storage area to the point value stored in the second storage area, when the total game play count reaches a certain value; and awards a benefit to the terminal device, when a total point value stored in the second storage area reaches a certain value.

7 Claims, 35 Drawing Sheets

BUTTON LAYOUT

FIG.14

POINT MANAGEMENT TABLE

| TYPE | POINTS |
|---|---|
| FESTIVAL MODE POINTS | 178 |
| FIRST PROGRESSIVE POINTS(GRAND) | 65 |
| SECOND PROGRESSIVE POINTS(MAJOR) | 91 |
| THIRD PROGRESSIVE POINTS (MINOR) | 257 |
| FOURTH PROGRESSIVE POINTS (MINI) | 1023 |
| CREDIT POINTS | 1436 |

FIG.15

BASE GAME POINT RANDOM DETERMINATION TABLE

| POINTS | SC01 | SC02 | SC03 | SC04 | SC05 | SC06 | SC07 | SC08 | SC09 | SC10 | SC11 | SC12 | SC13 | SC14 | SC15 | SC16 |
|---|---|---|---|---|---|---|---|---|---|---|---|---|---|---|---|---|
| 10 | 0 | 0 | 0 | 0 | 0 | 0 | 0 | 0 | 0 | 0 | 0 | 0 | 0 | 0 | 0 | 0 |
| 9 | 0 | 0 | 0 | 0 | 0 | 0 | 0 | 0 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 |
| 7 | 6 | 6 | 6 | 6 | 0 | 0 | 0 | 0 | 0 | 0 | 0 | 0 | 0 | 0 | 0 | 0 |
| 6 | 4 | 4 | 4 | 4 | 6 | 6 | 6 | 6 | 0 | 0 | 0 | 0 | 0 | 0 | 0 | 0 |
| 5 | 0 | 0 | 0 | 0 | 4 | 4 | 4 | 4 | 6 | 6 | 6 | 6 | 0 | 0 | 0 | 0 |
| 4 | 0 | 0 | 0 | 0 | 0 | 0 | 0 | 0 | 4 | 4 | 4 | 4 | 6 | 6 | 6 | 6 |
| 3 | 0 | 0 | 0 | 0 | 0 | 0 | 0 | 0 | 0 | 0 | 0 | 0 | 4 | 4 | 4 | 4 |
| 2 | 0 | 0 | 0 | 0 | 0 | 0 | 0 | 0 | 0 | 0 | 0 | 0 | 0 | 0 | 0 | 0 |
| 1 | 0 | 0 | 0 | 0 | 0 | 0 | 0 | 0 | 0 | 0 | 0 | 0 | 0 | 0 | 0 | 0 |
| | 10 | 10 | 10 | 10 | 10 | 10 | 10 | 10 | 10 | 10 | 10 | 10 | 10 | 10 | 10 | 10 |

FIG.16

FREE GAME POINT RANDOM DETERMINATION TABLE

| POINTS | V01 | V02 | V03 | V04 | V05 |
|---|---|---|---|---|---|
| 10 | 0 | 0 | 0 | 0 | 0 |
| 9 | 0 | 0 | 0 | 0 | 0 |
| 8 | 0 | 0 | 0 | 0 | 0 |
| 7 | 80602537490812 | 80602537490812 | 80602537490812 | 15658238644 | 15658238644 |
| 6 | 21773321856818 | 21773321856818 | 21773321856818 | 1087430456966 | 1087430456966 |
| 5 | 0 | 0 | 0 | 0 | 0 |
| 4 | 0 | 0 | 0 | 0 | 0 |
| 3 | 0 | 0 | 0 | 0 | 0 |
| 2 | 0 | 0 | 0 | 0 | 0 |
| 1 | 0 | 0 | 0 | 0 | 0 |
| | 102375859347630 | 102375859347630 | 102375859347630 | 1103088695610 | 1103088695610 |

FIG.17

FESTIVAL POINT SORTING RANDOM DETERMINATION TABLE

| | WEIGHT |
|---|---|
| NOT ACCUMULATED FOR FESTIVAL MODE | 19 |
| ACCUMULATED FOR FESTIVAL MODE | 1 |
| | 20 |

FIG.18

JACKPOT POINT SORTING RANDOM DETERMINATION TABLE

| | SC01 | SC02 | SC03 | SC04 | SC05 | SC06 | SC07 | SC08 | SC09 | SC10 | SC11 | SC12 | SC13 | SC14 | SC15 | SC16 |
|---|---|---|---|---|---|---|---|---|---|---|---|---|---|---|---|---|
| GRAND | 780 | 618 | 258 | 88 | 349 | 175 | 140 | 100 | 184 | 74 | 69 | 55 | 150 | 120 | 80 | 60 |
| MAJOR | 1160 | 1087 | 795 | 810 | 752 | 725 | 721 | 700 | 1927 | 1890 | 1915 | 1930 | 671 | 671 | 671 | 671 |
| MINOR | 36700 | 37000 | 37015 | 37020 | 37030 | 37000 | 37005 | 37000 | 47205 | 47195 | 47170 | 47175 | 37005 | 36855 | 36655 | 36555 |
| MINI | 61360 | 61295 | 61932 | 62082 | 61869 | 62100 | 62134 | 62200 | 50684 | 50841 | 50846 | 50840 | 62174 | 62354 | 62594 | 62714 |
| | 100000 | 100000 | 100000 | 100000 | 100000 | 100000 | 100000 | 100000 | 100000 | 100000 | 100000 | 100000 | 100000 | 100000 | 100000 | 100000 |

FIG.19

FIRST PROGRESSIVE PRE-SET POINT THRESHOLD SETTING TABLE

| No. | 1st orb | 2nd orb | 3rd orb | 4th orb | 5th orb | 6th orb | JP orb | WEIGHT |
|---|---|---|---|---|---|---|---|---|
| 1 | 3 | 10 | 300 | 305 | 1000 | 8000 | 80000 | 2 |
| 2 | 3 | 10 | 300 | 305 | 1000 | 8000 | 60000 | 2 |
| 3 | 3 | 10 | 300 | 305 | 1000 | 8000 | 40000 | 2 |
| 4 | 3 | 10 | 300 | 305 | 1000 | 8000 | 32000 | 3 |
| 5 | 3 | 10 | 300 | 305 | 1000 | 8000 | 20000 | 2 |
| 6 | 3 | 10 | 300 | 305 | 1000 | 8000 | 12000 | 2 |
| 7 | 7 | 10 | 1000 | 1300 | 1305 | 8000 | 80000 | 2 |
| 8 | 7 | 10 | 1000 | 1300 | 1305 | 8000 | 60000 | 2 |
| 9 | 7 | 10 | 1000 | 1300 | 1305 | 8000 | 40000 | 2 |
| 10 | 7 | 10 | 1000 | 1300 | 1305 | 8000 | 32000 | 3 |
| 11 | 7 | 10 | 1000 | 1300 | 1305 | 8000 | 20000 | 2 |
| 12 | 7 | 10 | 1000 | 1300 | 1305 | 8000 | 12000 | 2 |
| 13 | 20 | 40 | 1000 | 1300 | 3000 | 10000 | 80000 | 2 |
| 14 | 20 | 40 | 1000 | 1300 | 3000 | 10000 | 60000 | 2 |
| 15 | 20 | 40 | 1000 | 1300 | 3000 | 10000 | 40000 | 2 |
| 16 | 20 | 40 | 1000 | 1300 | 3000 | 10000 | 32000 | 3 |
| 18 | 20 | 40 | 1000 | 1300 | 3000 | 10000 | 20000 | 2 |
| 18 | 20 | 40 | 1000 | 1300 | 3000 | 10000 | 12000 | 2 |
| 19 | 40 | 1000 | 1300 | 2600 | 10000 | 10003 | 80000 | 2 |
| 20 | 40 | 1000 | 1300 | 2600 | 10000 | 10003 | 60000 | 2 |
| 21 | 40 | 1000 | 1300 | 2600 | 10000 | 10003 | 40000 | 2 |
| 22 | 40 | 1000 | 1300 | 2600 | 10000 | 10003 | 32000 | 3 |
| 23 | 40 | 1000 | 1300 | 2600 | 10000 | 10003 | 20000 | 2 |
| 24 | 40 | 1000 | 1300 | 2600 | 10000 | 10003 | 12000 | 2 |
| 25 | | | | | | | | |
| | | | | | | | | 52 |

FIG.20

SECOND PROGRESSIVE PRE-SET POINT
THRESHOLD SETTING TABLE

| No. | 1st orb | 2nd orb | 3rd orb | 4th orb | JP orb | WEIGHT |
|---|---|---|---|---|---|---|
| 1 | 3 | 10 | 300 | 5000 | 60000 | 2 |
| 2 | 3 | 10 | 300 | 5000 | 45000 | 2 |
| 3 | 3 | 10 | 300 | 5000 | 30000 | 2 |
| 4 | 3 | 10 | 300 | 5000 | 24000 | 3 |
| 5 | 3 | 10 | 300 | 5000 | 15000 | 2 |
| 6 | 3 | 10 | 300 | 5000 | 9000 | 2 |
| 7 | 7 | 10 | 1000 | 5000 | 60000 | 2 |
| 8 | 7 | 10 | 1000 | 5000 | 45000 | 2 |
| 9 | 7 | 10 | 1000 | 5000 | 30000 | 2 |
| 10 | 7 | 10 | 1000 | 5000 | 24000 | 3 |
| 11 | 7 | 10 | 1000 | 5000 | 15000 | 2 |
| 12 | 7 | 10 | 1000 | 5000 | 9000 | 2 |
| 13 | 20 | 40 | 1300 | 7000 | 60000 | 2 |
| 14 | 20 | 40 | 1300 | 7000 | 45000 | 2 |
| 15 | 20 | 40 | 1300 | 7000 | 30000 | 2 |
| 16 | 20 | 40 | 1300 | 7000 | 24000 | 3 |
| 17 | 20 | 40 | 1300 | 7000 | 15000 | 2 |
| 18 | 20 | 40 | 1300 | 7000 | 9000 | 2 |
| 19 | 40 | 1000 | 7000 | 7005 | 60000 | 2 |
| 20 | 40 | 1000 | 7000 | 7005 | 45000 | 2 |
| 21 | 40 | 1000 | 7000 | 7005 | 30000 | 2 |
| 22 | 40 | 1000 | 7000 | 7005 | 24000 | 3 |
| 23 | 40 | 1000 | 7000 | 7005 | 15000 | 2 |
| 24 | 40 | 1000 | 7000 | 7005 | 9000 | 2 |
| 25 | | | | | | |
| | | | | | | 52 |

FIG.21

THIRD PROGRESSIVE PRE-SET POINT
THRESHOLD SETTING TABLE

| No. | 1st orb | 2nd orb | 3rd orb | JP orb | WEIGHT |
|---|---|---|---|---|---|
| 1 | 10 | 50 | 400 | 10000 | 2 |
| 2 | 10 | 50 | 400 | 7500 | 2 |
| 3 | 10 | 50 | 400 | 5000 | 2 |
| 4 | 10 | 50 | 400 | 4000 | 3 |
| 5 | 10 | 50 | 400 | 2500 | 2 |
| 6 | 10 | 50 | 400 | 1500 | 2 |
| 7 | 10 | 300 | 600 | 10000 | 2 |
| 8 | 10 | 300 | 600 | 7500 | 2 |
| 9 | 10 | 300 | 600 | 5000 | 2 |
| 10 | 10 | 300 | 600 | 4000 | 3 |
| 11 | 10 | 300 | 600 | 2500 | 2 |
| 12 | 10 | 300 | 600 | 1500 | 2 |
| 13 | 20 | 400 | 800 | 10000 | 2 |
| 14 | 20 | 400 | 800 | 7500 | 2 |
| 15 | 20 | 400 | 800 | 5000 | 2 |
| 16 | 20 | 400 | 800 | 4000 | 3 |
| 17 | 20 | 400 | 800 | 2500 | 2 |
| 18 | 20 | 400 | 800 | 1500 | 2 |
| 19 | 40 | 500 | 1000 | 10000 | 2 |
| 20 | 40 | 500 | 1000 | 7500 | 2 |
| 21 | 40 | 500 | 1000 | 5000 | 2 |
| 22 | 40 | 500 | 1000 | 4000 | 3 |
| 23 | 40 | 500 | 1000 | 2500 | 2 |
| 24 | 40 | 500 | 1000 | 1500 | 2 |
| 25 | | | | | 2 |
| | | | | | 52 |

FIG.22

FOURTH PROGRESSIVE PRE-SET POINT THRESHOLD SETTING TABLE

| No. | 1st orb | 2nd orb | JP orb | WEIGHT |
|---|---|---|---|---|
| 1 | 15 | 60 | 6000 | 2 |
| 2 | 15 | 60 | 4500 | 2 |
| 3 | 15 | 60 | 3000 | 3 |
| 4 | 15 | 60 | 2400 | 4 |
| 5 | 15 | 60 | 1500 | 2 |
| 6 | 15 | 60 | 1200 | 2 |
| 7 | 20 | 300 | 6000 | 2 |
| 8 | 20 | 300 | 4500 | 2 |
| 9 | 20 | 300 | 3000 | 3 |
| 10 | 20 | 300 | 2400 | 4 |
| 11 | 20 | 300 | 1500 | 2 |
| 12 | 20 | 300 | 1200 | 2 |
| 13 | 30 | 400 | 6000 | 2 |
| 14 | 30 | 400 | 4500 | 2 |
| 15 | 30 | 400 | 3000 | 3 |
| 16 | 30 | 400 | 2400 | 4 |
| 17 | 30 | 400 | 1500 | 2 |
| 18 | 30 | 400 | 1200 | 2 |
| 19 | 50 | 600 | 6000 | 2 |
| 20 | 50 | 600 | 4500 | 2 |
| 21 | 50 | 600 | 3000 | 3 |
| 22 | 50 | 600 | 2400 | 4 |
| 23 | 50 | 600 | 1500 | 2 |
| 24 | 50 | 600 | 1200 | 2 |
| 25 | | | | |
| | | | | 60 |

FIG.23

CREDIT PAYOUT RANDOM DETERMINATION TABLE FOR OCCASION OF WINNING ORB

| PAYOUT | WEIGHT | | | | | | | | | | | | | | | |
|---|---|---|---|---|---|---|---|---|---|---|---|---|---|---|---|---|
| | SC01 | SC02 | SC03 | SC04 | SC05 | SC06 | SC07 | SC08 | SC09 | SC10 | SC11 | SC12 | SC13 | SC14 | SC15 | SC16 |
| 0 | 0 | 0 | 0 | 0 | 0 | 0 | 0 | 0 | 0 | 0 | 0 | 0 | 0 | 0 | 0 | 0 |
| 25 | 6284 | 6309 | 6333 | 6359 | 3948 | 3989 | 3997 | 4005 | 2727 | 2744 | 2741 | 2740 | 1815 | 1826 | 1836 | 1845 |
| 50 | 1742 | 1718 | 1735 | 1709 | 3770 | 3729 | 3721 | 3715 | 3664 | 3657 | 3660 | 3661 | 3662 | 3655 | 3652 | 3645 |
| 100 | 1585 | 1584 | 1545 | 1545 | 1875 | 1875 | 1875 | 1873 | 2752 | 2742 | 2742 | 2742 | 2754 | 2750 | 2744 | 2742 |
| 150 | 350 | 350 | 348 | 348 | 368 | 368 | 368 | 368 | 784 | 784 | 784 | 784 | 1584 | 1584 | 1583 | 1583 |
| 300 | 30 | 30 | 30 | 30 | 30 | 30 | 30 | 30 | 50 | 50 | 50 | 50 | 140 | 140 | 140 | 140 |
| 500 | 5 | 5 | 5 | 5 | 5 | 5 | 5 | 5 | 13 | 13 | 13 | 13 | 25 | 25 | 25 | 25 |
| 1000 | 4 | 4 | 4 | 4 | 4 | 4 | 4 | 4 | 10 | 10 | 10 | 10 | 20 | 20 | 20 | 20 |
| | 10000 | 10000 | 10000 | 10000 | 10000 | 10000 | 10000 | 10000 | 10000 | 10000 | 10000 | 10000 | 10000 | 10000 | 10000 | 10000 |

FIG.24

CREDIT PAYOUT TIME EFFECT
RANDOM DETERMINATION TA

| METHOD | WEIGHT |
|---|---|
| OVERLAP SYMBOL | 624 |
| MYSTERY | 1 |
| | 625 |

FIG.25

NORMAL STATE CREDIT POINT PAYOUT RANDOM DETERMINATION TABLE

| PAYOUT | WEIGHT | | | | | |
|---|---|---|---|---|---|---|
| | V01 | V02 | V03 | V04 | V05 | V06 |
| 0 | 4000 | 4000 | 4000 | 4000 | 4000 | 4000 |
| 25 | 1404 | 1234 | 1156 | 1100 | 1000 | 900 |
| 50 | 1554 | 1573 | 1554 | 1366 | 1315 | 1271 |
| 100 | 878 | 910 | 958 | 1096 | 1126 | 1160 |
| 150 | 150 | 260 | 304 | 404 | 505 | 605 |
| 300 | 8 | 15 | 20 | 25 | 43 | 44 |
| 500 | 3 | 4 | 4 | 5 | 6 | 12 |
| 1000 | 3 | 4 | 4 | 4 | 5 | 8 |
| | 8000 | 8000 | 8000 | 8000 | 8000 | 8000 |

FIG.26

FESTIVAL MODE CREDIT POINT PAYOUT RANDOM DETERMINATION TABLE

| PAYOUT | WEIGHT | | | | | |
|---|---|---|---|---|---|---|
| | V01 | V02 | V03 | V04 | V05 | V06 |
| 0 | 44000 | 44000 | 44000 | 44000 | 44000 | 44000 |
| 25 | 1404 | 1234 | 1156 | 1100 | 1000 | 900 |
| 50 | 1554 | 1573 | 1554 | 1366 | 1315 | 1271 |
| 100 | 878 | 910 | 958 | 1096 | 1126 | 1160 |
| 150 | 150 | 260 | 304 | 404 | 505 | 605 |
| 300 | 8 | 15 | 20 | 25 | 43 | 44 |
| 500 | 3 | 4 | 4 | 5 | 6 | 12 |
| 1000 | 3 | 4 | 4 | 4 | 5 | 8 |
| | 48000 | 48000 | 48000 | 48000 | 48000 | 48000 |

FIG.27

GAME PLAY COUNT RANDOM DETERMINATION TABLE

| GAME PLAY COUNT |
|---|
| 2000 |
| 2200 |
| 2400 |
| 2600 |
| 2800 |
| 3000 |
| 3200 |
| 3400 |
| 3600 |
| 3800 |
| 4000 |

FIG.28

GAME PLAY COUNT MANAGEMENT TABLE

| GAMING TERMINAL | GAME PLAY COUNT |
|---|---|
| 01 | 1853 |
| 02 | 212 |
| 03 | 894 |
| 04 | 167 |
| 05 | 2006 |

FIG.29

INCREMENT RATE TABLE

| PROGRESSIVE CONFIGURATION | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| PROGRESSIVE1 | 0.15% | 0.15% | 0.15% | 0.15% | 0.15% | 0.15% | 0.15% | 0.15% | 0.15% | 0.15% | 0.15% | 0.15% | 0.15% | 0.15% | 0.15% | 0.15% |
| PROGRESSIVE2 | 0.25% | 0.25% | 0.25% | 0.25% | 0.25% | 0.25% | 0.25% | 0.25% | 0.25% | 0.25% | 0.25% | 0.25% | 0.25% | 0.25% | 0.25% | 0.25% |
| PROGRESSIVE3 | 0.60% | 0.60% | 0.60% | 0.60% | 0.60% | 0.60% | 0.60% | 0.60% | 0.60% | 0.60% | 0.60% | 0.60% | 0.60% | 0.60% | 0.60% | 0.60% |
| PROGRESSIVE4 | 1.00% | 1.00% | 1.00% | 1.00% | 1.00% | 1.00% | 1.00% | 1.00% | 1.00% | 1.00% | 1.00% | 1.00% | 1.00% | 1.00% | 1.00% | 1.00% |

FIG.30

BASE VALUE SETTING TABLE

| PROGRESSIVE CONFIGURATION | 1 | 2 | 3 | 4 | 5 | 6 | 7 | 8 |
|---|---|---|---|---|---|---|---|---|
| PROGRESSIVE1 | 200,000 | 250,000 | 500,000 | 2,500,000 | 1,000,000 | 2,000,000 | 2,500,000 | 5,000,000 |
| PROGRESSIVE2 | 25,000 | 25,000 | 50,000 | 100,000 | 100,000 | 100,000 | 100,000 | 100,000 |
| PROGRESSIVE3 | 2,000 | 2,000 | 2,000 | 1,500 | 2,000 | 2,000 | 2,000 | 1,500 |
| PROGRESSIVE4 | 1,000 | 1,000 | 1,000 | 1,000 | 1,000 | 1,000 | 1,000 | 1,000 |

| PROGRESSIVE CONFIGURATION | 9 | 10 | 11 | 12 | 13 | 14 | 15 | 16 |
|---|---|---|---|---|---|---|---|---|
| PROGRESSIVE1 | 3,000,000 | 7,500,000 | 8,000,000 | 10,000,000 | 8,000,000 | 10,000,000 | 15,000,000 | 20,000,000 |
| PROGRESSIVE2 | 100,000 | 100,000 | 100,000 | 100,000 | 200,000 | 200,000 | 200,000 | 200,000 |
| PROGRESSIVE3 | 2,000 | 2,000 | 2,000 | 2,000 | 2,000 | 2,000 | 2,000 | 2,000 |
| PROGRESSIVE4 | 1,000 | 1,000 | 1,000 | 1,000 | 1,000 | 1,000 | 1,000 | 1,000 |

GAMING MACHINE

CROSS-REFERENCES TO RELATED APPLICATIONS

This Application is Entitled to the benefit of Provisional Patent Application No. 62/335,770, filed May 13, 2016.

BACKGROUND OF THE INVENTION

1. Field of the Invention

The present invention relates to a gaming machine.

2. Description of Related Art

As disclosed in the specifications of U.S. Pat. No. 5,564,700, No. 6077162, No. 6375568, and No. 6312332, gaming machines are traditionally provided with a plurality of gaming terminals, a plurality of terminal controllers respectively provided in and control the gaming terminals, and a center controller configured to control the terminal controllers. Such gaming machines each has a function of enabling execution of a jackpot in the gaming terminals, in addition to a base game which is executed in the gaming terminals independently of one another, and awarding a benefit of the jackpot.

From the above, it is seen that variety of forms of benefits awarded in relation to gaming terminals, such as a jackpot awarded apart from the base game, have been perceived as effective to the entertainment characteristics of a game of a gaming machine.

SUMMARY OF THE INVENTION

An object of the present invention is to provide a gaming machine in which awarding of a benefit to a gaming terminal is made complex to improve the entertainment characteristic.

According to an aspect of the present invention, a gaming machine includes:

at least one terminal device which is configured to run a game;

a storage device configured to store information related to the game run in the terminal device;

a benefit awarding device configured to award a benefit (jackpot, credit payout) to the terminal device; and a controller configured to execute the following processes of (A1) generating a point value in each game play in the terminal device;

(A2) storing in the storage device a first total value (for festival mode) resulting from addition involving the point value generated in the process of (A1);

(A3) storing in the storage device a second total value (for jackpot, for credit) resulting from an addition involving the point value generated in the process (A1);

(A4) subtracting a predetermined point value from the first total value and adding that predetermined point value to the second total value, during a special mode (festival mode) which occurs when a predetermined condition is met; and (A5) the benefit awarding device awarding a benefit to the terminal device, when the second total value reaches a certain value.

The above structure achieves more complexed variation in the time taken before a benefit awarding for a terminal device occurs, by associating such variation with the game-related points and the game play count, which leads to an improved entertainment characteristics of the game.

The gaming machine of the above aspect of the present invention is adapted so that in the process (A1), the game play count is counted up at each game play; and in the process of (A4), a predetermined condition is determined as to be achieved, when the game play count of the game in the terminal device reaches a certain value.

The gaming machine of the above aspect of the present invention is adapted so that the process of (A4) repeats, in each game play, a process of stopping execution of the process of (A1) during the special mode, and subtracting the predetermined point value from the first total value and adding that predetermined point value to the second total value.

The gaming machine of the above aspect of the present invention is adapted so that the process of (A4) repeats, in each game play during a predetermined period after the special mode is started, a process of stopping execution of the process of (A1) during the special mode, and subtracting the predetermined point value from the first total value and adding that predetermined point value to the second total value.

The gaming machine of the above aspect of the present invention is adapted so that whether to execute the above process of (A2) or execute the above process of (A3) is randomly determined, in a normal mode until the total game play count reaches a certain value.

According to an aspect of the present invention, a gaming machine includes:

at least one terminal device which is configured to run a game;

a storage device configured to store information related to the game run in the terminal device;

a benefit awarding device configured to award a benefit (jackpot, credit payout) to the terminal device; and a controller configured to execute the following processes of (B1) in each game play in the terminal device, counting up the game play count, and then storing the game play count in the storage device;

(B2) generating a point value for each game play in the terminal device;

(B3) storing in the storage device a first total value (for festival mode) resulting from addition involving the point value generated in the process of (B2);

(B4) storing in the storage device a jackpot total value resulting from addition involving the point value generated in the process of (B2);

(B5) storing in the storage device a credit total value (for credit) resulting from an addition involving the point value generated in the process (B2);

(B6) subtract a predetermined point value from the first total value and adding that predetermined point value to the jackpot total value and to the credit total value, during a special mode (festival mode) which occurs when the game play count in (B1) reaches a certain value; and (B7) the benefit awarding device awarding a first benefit (jackpot orb) to the terminal device when the jackpot total value reaches a first setting value out of a plurality of setting values including a minimum and a maximum, and awarding a special benefit (jackpot) when the jackpot total value reaches the maximum first setting value;

(B8) the benefit awarding device awarding a second benefit (credit payout) to the terminal device when the credit total value reaches a second setting value out of a plurality of setting values including a minimum and a maximum.

The above structure achieves more complexed variation in the time taken before a benefit awarding for a terminal device occurs, by associating such variation with the game-related points and the game play count, which leads to an improved entertainment characteristics of the game.

The gaming machine of the above aspect of the present invention is adapted so that in the process of (B4), a jackpot level is randomly selected out of a plurality of jackpot levels each associated with the jackpot total value, and the point value generated in the process (B2) are added to the jackpot total value associated with the selected jackpot level.

An aspect of the present invention is a gaming machine including:

at least one terminal device which is configured to run a game;

a storage device configured to store a point value generated in the game in the terminal device and a game play count;

a benefit awarding device configured to award a benefit to the terminal device; and a controller configured to execute the following processes of (C1) storing, in a game play count storage area of the storage device, a total game play count which is incremented in each game play in the terminal device;

(C2) accumulatively storing a portion of the total point value in a first storage area of the storage device, and accumulatively storing the remaining portion of the total point value in a second storage area of the storage device;

(C3) adding the point value stored in the first storage area to the point value stored in the second storage area, when the total game play count stored in the game play count storage area reaches a certain value; and (C4) the benefit awarding device awarding a benefit to the terminal device, when a total point value in the second storage area reaches a certain value.

The above structure achieves more complexed variation in the time taken before a benefit awarding for a terminal device occurs, by associating such variation with the game-related points and the game play count, which leads to an improved entertainment characteristics of the game.

BRIEF DESCRIPTION OF THE DRAWINGS

FIG. 14 is an explanatory diagram of a normal game symbols.

FIG. 15 is an explanatory diagram of a base game point random determination table.

FIG. 16 is an explanatory diagram of a free game point random determination table.

FIG. 17 is an explanatory diagram of a festival point sorting random determination table.

FIG. 18 is an explanatory diagram of a jackpot point distribution random determination table.

FIG. 19 is an explanatory diagram of a first progressive prescribed point setting table.

FIG. 20 is an explanatory diagram of a second progressive prescribed point setting table.

FIG. 21 is an explanatory diagram of a third progressive prescribed point setting table.

FIG. 22 is an explanatory diagram of a fourth progressive prescribed point setting table.

FIG. 23 is an explanatory diagram of a credit payout random determination table for occasions of winning an orb.

FIG. 24 is an explanatory diagram of a credit payout time effect random determination table.

FIG. 25 is an explanatory diagram of a normal state credit point payout random determination table.

FIG. 26 is an explanatory diagram of a festival mode credit point payout random determination table.

FIG. 27 is an explanatory diagram of a game play count random determination table.

FIG. 28 is an explanatory diagram of a game play count management table.

FIG. 29 is an explanatory diagram of an increment rate table.

FIG. 30 is an explanatory diagram of a base value setting table.

DETAILED DESCRIPTION OF THE INVENTION

The following will describe an embodiment of the present invention with reference to figures.

(Outline of Present Invention)

Figure 1A:
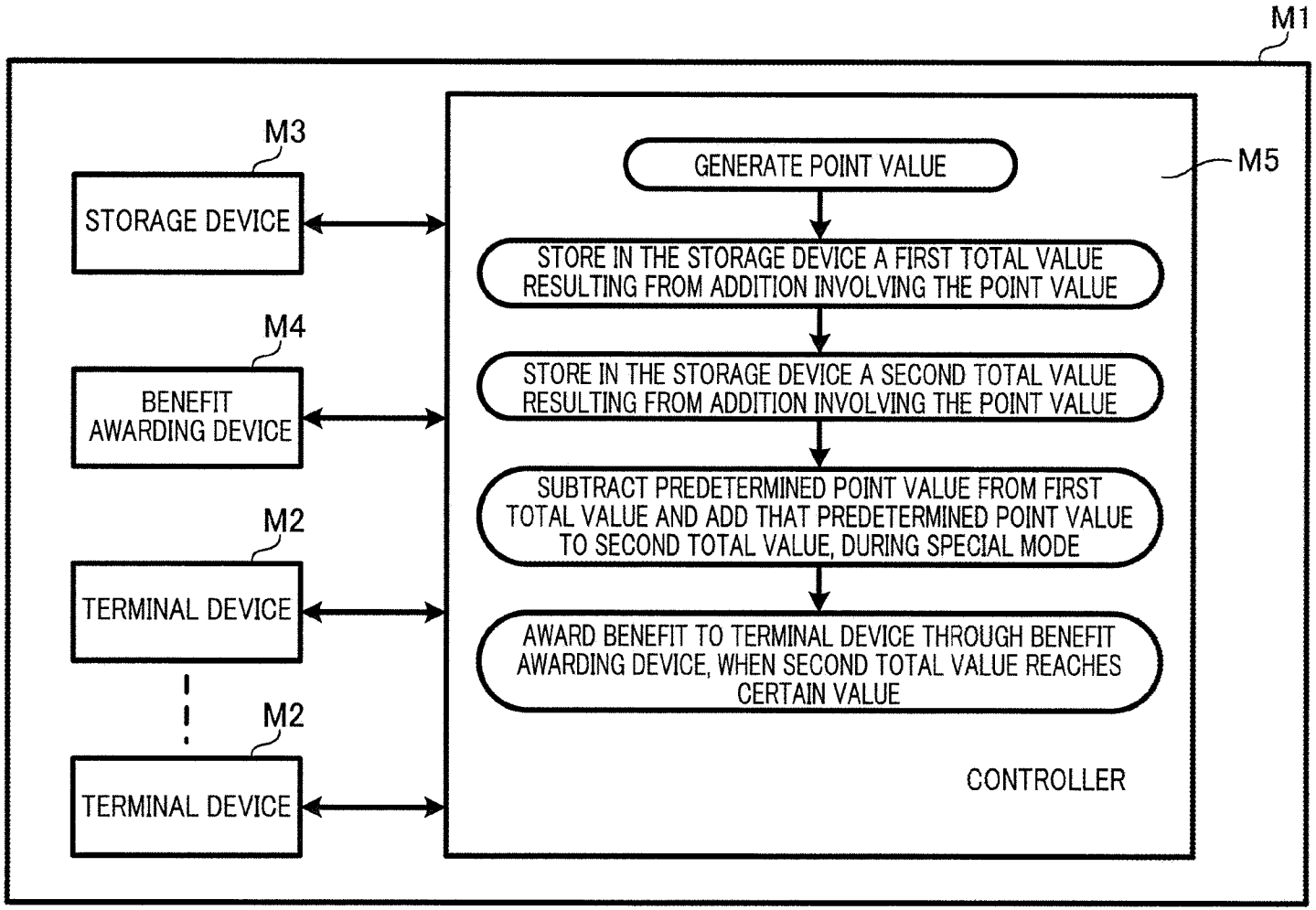
FIG. 1A is an explanatory diagram of a gaming machine.

As shown in FIG. 1A, the gaming machine M1 includes: a storage device M3 configured to store one or more points generated in the game in at least one terminal device M2 and the game play count; a benefit awarding device M4 configured to award a benefit to the terminal device M2; and a controller M5.

The controller M5 is configured to execute the processes of: generating a point value in each game play in the terminal device M2 (A1); storing in the storage device M3 a first total value (for festival mode) resulting from addition involving the point value generated in the process of (A1) (A2); storing in the storage device M3 a second total value (for jackpot, for credit) resulting from an addition involving the point value generated in the process (A1) (A3); subtracting a predetermined point value from the first total value and adding that predetermined point value to the second total value, during a special mode (festival mode) which occurs when a predetermined condition is met (A4); and the benefit awarding device M4 awarding a benefit to the terminal device M2, when the second total value reaches a certain value (A5). That is, the controller M5 has a processing unit which executes each of the steps A1 to A5.

The above structure achieves more complexed variation in the time taken before a benefit awarding for a terminal device M2 occurs, by associating such variation with the game-related points and the game play count, which leads to an improved entertainment characteristics of the game.

The "point value" in the above may be anything that occurs as the result of a game run in the terminal device M2, and is not necessarily based on the content of the game run. In other words, the running process of a game in the terminal device M2 includes a process of generating a predetermined point value. It should be noted that the point value does not necessarily have to be generated in each game play.

Generating a point value means confirming a numerical value to be added to a total point value. Further, the point value generated may be a numerical value corresponding to a bet amount for the game played. Further, the point value generated may be a numerical value corresponding to a result of the game played. Further, the point value generated may be a numerical value randomly determined out of a predetermined range. Further, the point value generated may be always a constant numerical value. The wording "benefit" may be a payout to the player, for example. Alternatively, the "benefit" may be a change in the gaming status allows a player an advantageous game play.

The storage device M3 and the controller M5 do not have to be separately provided from the terminal device M2 and the benefit awarding device M4. For example, the benefit awarding device M4 may be provided therein with a game play count storage area M31, and the terminal device M2 may be provided therein with a first storage area M32 and the second storage area M33. Further, the functions of the controller M5 may be scatteringly provided in the terminal device M2 and the benefit awarding device M4. Alternatively, either one of the terminal device M2 and the benefit awarding device M4 may have the functions of the controller M5.

It should be noted that the controller M5 may be configured so that, in the process (A1), the game play count is counted up at each play of the game; and in the process of (A4), a predetermined condition is determined as to be achieved, when the game play count of the game in the terminal device reaches a certain value.

Further, the controller M5 may be configured so that the process of (A4) repeats, in each game play, a process of stopping execution of the process of (A1) during the special mode, and subtracting the predetermined point value from the first total value and adding that predetermined point value to the second total value.

Further, the controller M5 may be configured so that the process of (A4) repeats, in each game play during a predetermined period after the special mode is started, a process of stopping execution of the process of (A1) during the special mode, and subtracting the predetermined point value from the first total value and adding that predetermined point value to the second total value.

Further, the controller M5 may be configured so that whether to execute the above process of (A2) or execute the above process of (A3) is randomly determined, in a normal mode until the total game play count reaches a certain value.

Figure 1B:
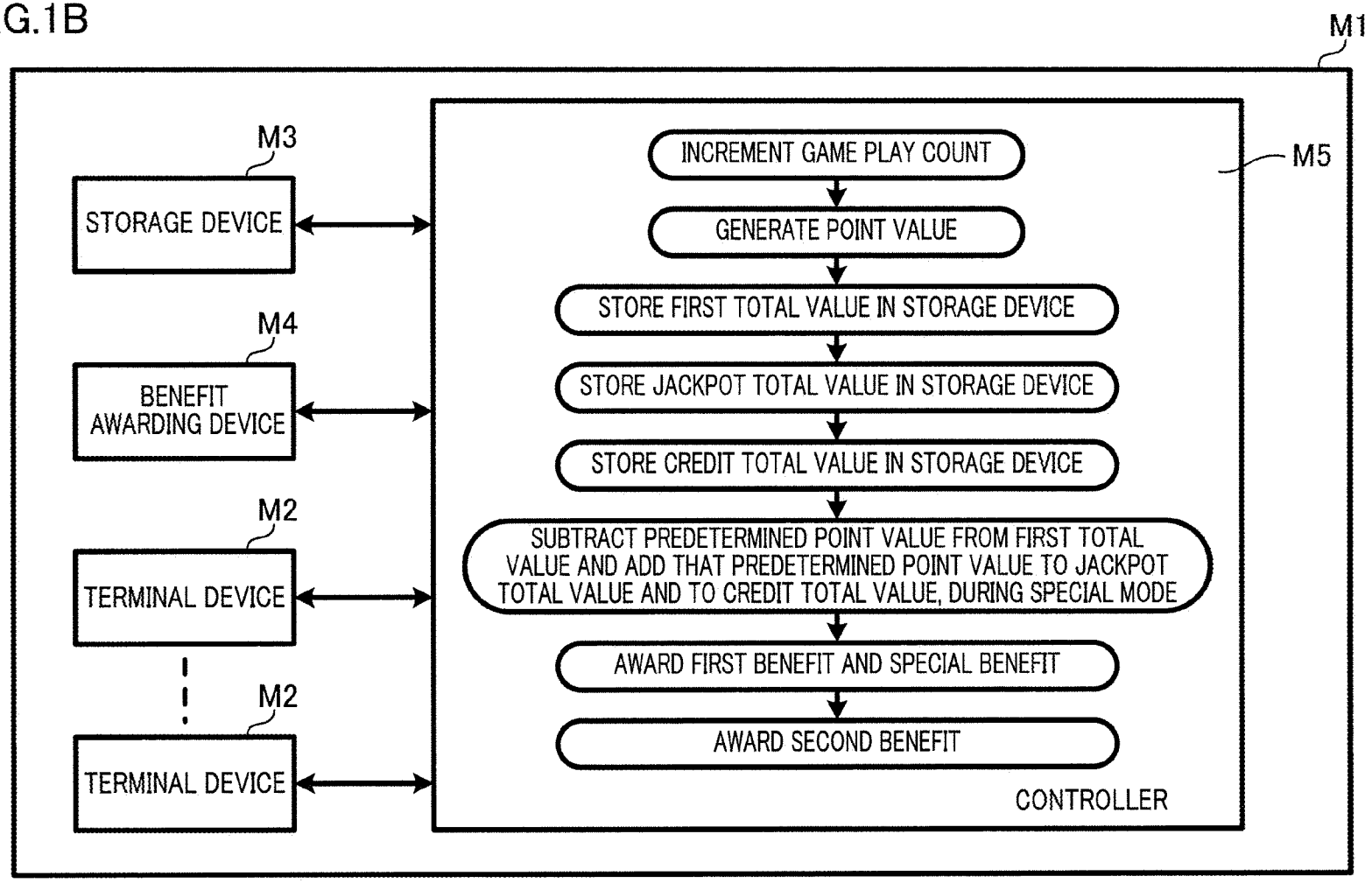
FIG. 1B is an explanatory diagram of a gaming machine.

As shown in FIG. 1B, the controller M5 may be configured to execute the processes of: in each game play in the terminal device M2, counting up the game play count, and then storing the game play count in the storage device M3 (B1); generating a point value for each game play in the terminal device M2 (B2); storing in the storage device M3 a first total value (for festival mode) resulting from addition involving the point value generated in the process of (B2) (B3); storing in the storage device M3 a jackpot total value (for jackpot) resulting from addition involving the point value generated in the process of (B2) (B4); storing in the storage device M3 a credit total value (for credit) resulting from an addition involving the point value generated in the process (B2) (B5); subtract a predetermined point value from the first total value and adding that predetermined point value to the jackpot total value and to the credit total value, during a special mode (festival mode) which occurs when the game play count in (B1) reaches a certain value (B6); and the benefit awarding device M4 awarding a first benefit (jackpot orb) to the terminal device M2 when the jackpot total value reaches a first setting value out of a plurality of setting values including a minimum and a maximum, and awarding a special benefit (jackpot) when the jackpot total value reaches the maximum first setting value (B7); the benefit awarding device M4 awarding a second benefit (credit payout) to the terminal device M2 when the credit total value reaches a second setting value out of a plurality of setting values including a minimum and a maximum (B7). That is, the controller M5 has a processing unit which executes each of the steps B1 to B7.

The above structure achieves more complexed variation in the time taken before a benefit awarding for a terminal device M2 occurs, by associating such variation with the game-related points and the game play count, which leads to an improved entertainment characteristics of the game.

Figure 1C:
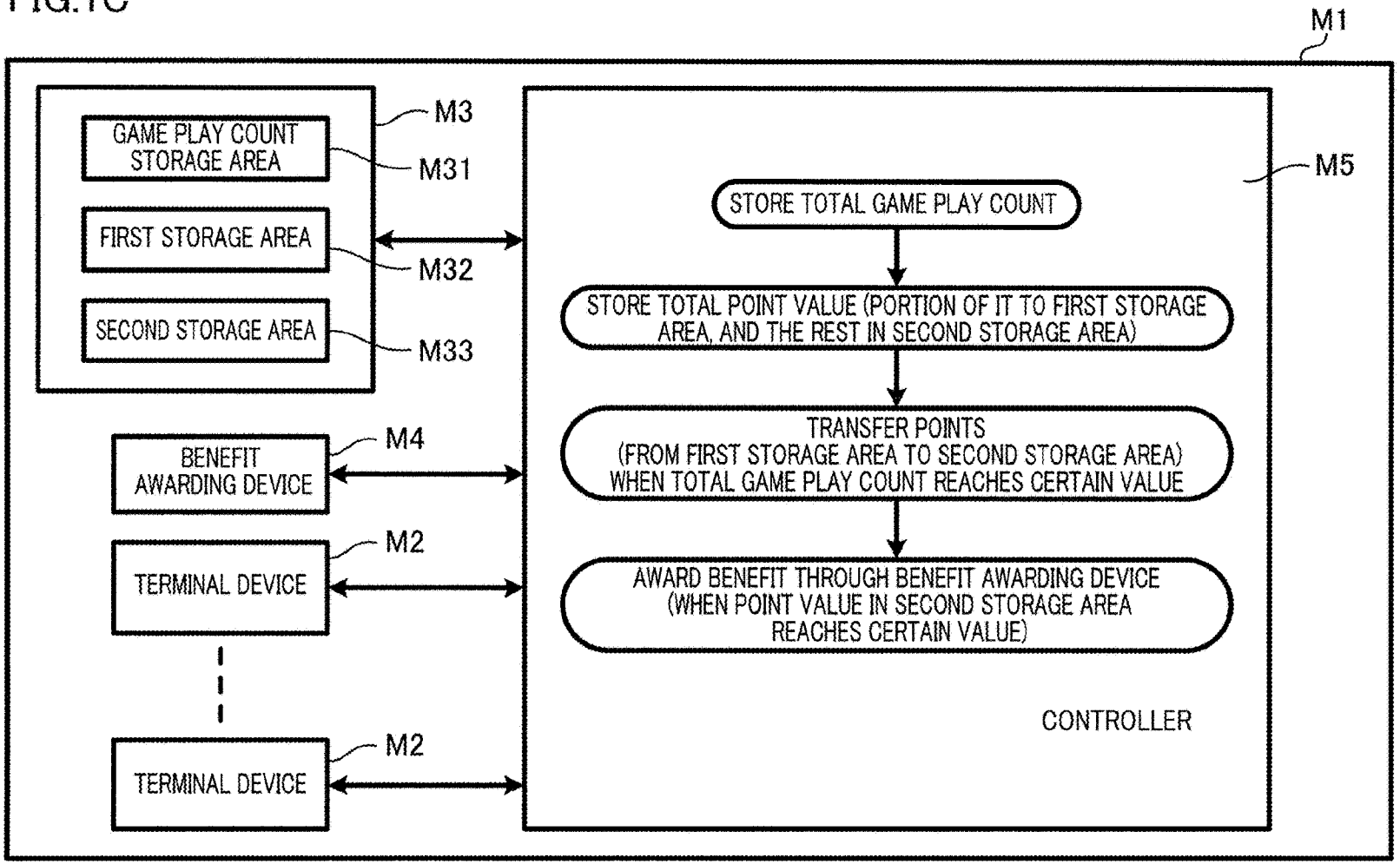
FIG. 1C is an explanatory diagram of a gaming machine.

The controller M5 may be structured as shown in FIG. 1C, in cases where the controller M5 is mounted in a gaming machine 1 configured so that a point value generated at each game play is used as a total value for a festival mode, and this total value for the festival mode is also used as the point value for a jackpot or a credit.

The controller M5 executes a process of storing, in a game play count storage area M31 of the storage device M3, a total game play count which is incremented in each game play in the terminal device M2 (C1). Then, the controller M5 executes a process of accumulatively storing a portion of the total point value in a first storage area M32 of the storage device M3, and accumulatively storing the remaining portion of the total point value in a second storage area M33 of the storage device M3 (C2). After that, the controller M5 executes a process of adding the point value stored in the first storage area M32 to the point value stored in the second storage area M33, when the total game play count stored in the game play count storage area M31 reaches a certain value (C3). Then, the controller M5 causes the benefit awarding device M4 to award a benefit to the terminal device M2, when a total point value in the second storage area reaches a certain value (C4). That is, the controller M5 has a processing unit which executes each of the steps S1 to S4.

The above structure achieves more complexed variation in the time taken before a benefit awarding for a terminal device M2 occurs, by associating such variation with the game-related points and the game play count, which leads to an improved entertainment characteristics of the game.

(Specific Example of the Present Invention)

The following describes a specific example gaming machine adopting the above described structure.

Figure 2:
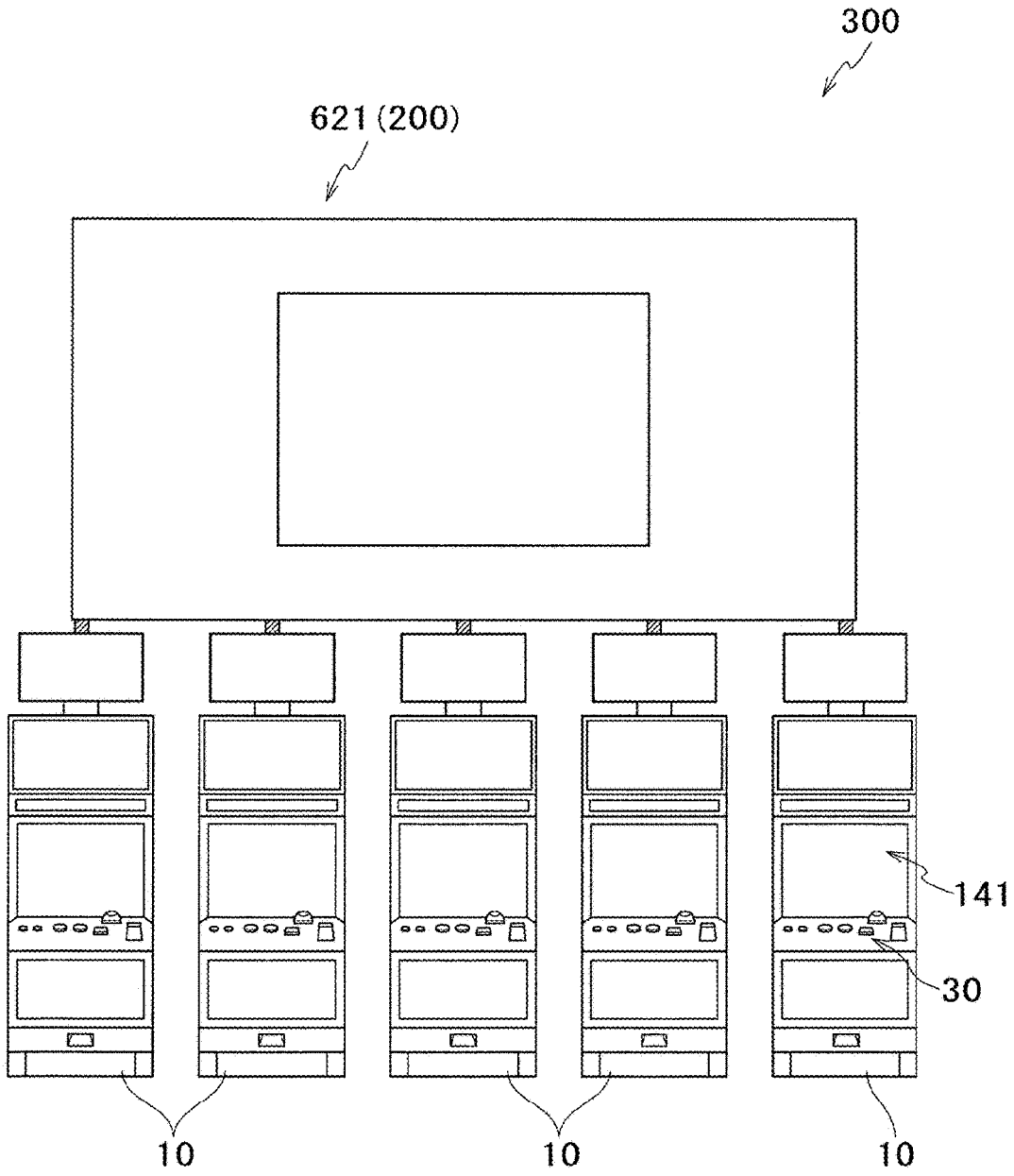
FIG. 2 is a frontal view showing the entire gaming machine.

As shown in FIG. 2, a gaming machine 300 of the present embodiment adopts a structure that allows participation of multiple players, and includes a plurality of (five) gaming terminals 10 arranged side by side, which terminals are connected to a center controller 200 in such a manner as to enable data communication. The gaming machine 300 is capable of running a slot game in the gaming terminals 10 independently of one another. When this slot game is run, there will be an effect of a plurality of symbols being rearranged on a lower image display panel 141 of each gaming terminal 10.

The free game may be of any type as long as a different game state is established from that in the base game. The free game is a game runnable with a bet of fewer gaming values (credit) than that in the base game. Note that "bet of fewer amounts of gaming values" encompasses a bet of zero gaming value. The "free game" therefore may be a game runnable without a bet of a gaming value, which free game awards an amount of gaming values based on symbols rearranged. In other words, the "free game" may be a game which is started without consumption of a gaming value. To the contrary, the "base game" is a game runnable on condition that a gaming value is bet, which normal game can award an amount of gaming value based on the symbols rearranged. In other words, the "base game" is a game which is started with consumption of a gaming value.

A coin, a bill, or electrically valuable information corresponding to these is used as a gaming value (credit). Note that the gaming value in the present invention is not particularly limited. Examples of the gaming medium include game media such as medals, tokens, cyber money, tickets, and the like. A ticket is not particularly limited, and a later-mentioned barcoded ticket may be adopted, for example.

The term "rearrangement" indicates that the symbols are rearranged after the arrangement of the symbols is dismissed. Arrangement means a state where the symbols can be visibly confirmed by a player.

(Functional Flow)

The following describes basic functions of the gaming terminal 10 as a slot machine.

<Start-Check>

First, the slot machine checks whether a bet button has been pressed by a player, and subsequently checks whether a spin button has been pressed by the player.

<Symbol Determination>

Next, when the spin button has been pressed by the player, the slot machine extracts a random number for symbol determination, and determines symbols to be displayed to the player at the time of stopping the scroll of the symbol arrays, for respective video reels displayed on a display.

<Symbol Display>

Then the slot machine starts the scroll of the symbol array of each video reel, and stops the scroll so that the determined symbols are displayed to the player.

<Winning Determination>

Subsequently, as the scroll of the symbol array of each video reel is stopped, the slot machine determines whether the combination of the symbols displayed to the player is a combination related to a winning.

<Payout>

When the combination of the symbols displayed to the player is a combination related to a winning, the slot machine offers, to the player, a benefit according to the combination. For example, when a combination of symbols related to a payout of coins is displayed, the slot machine pays out, to the player, coins of the amount corresponding to the combination of the displayed symbols.

When a combination of the symbols related to a free game trigger is displayed, the slot machine starts a free game. In the embodiment of the present invention, the free game is a game executed without consumption of coins, in which random determination for the aforementioned determination of the to-be-stopped symbols is conducted a predetermined number of times.

In addition to the above-described benefit, the slot machine is provided with a benefit such as a mystery feature. The mystery feature is awarded when a winning is made in the random determination for the mystery feature, and specifically, awarded is a predetermined number of plays of free game. When the spin button is pressed, the slot machine extracts a random number for the mystery bonus and randomly determines whether a mystery feature trigger is established.

The function of rescue provided in the present embodiment is for saving the player when the free game is not executed for a long period of time. That is, with this function, when the number of plays of the game reaches a predetermined value without receiving a predetermined benefit, some of the bet is returned to the player to save the player.

Whether the function of rescue is activated or not is freely selectable by an administrator of the slot machine. If the rescue is activated, the slot machine starts to count the number of plays of the game. When the counted number of plays of the game reaches a predetermined number without a large amount of payout due to the free game or the like, the slot machine awards a benefit such as the free game.

Further, the slot machine may be configured so that, when a combination of symbols related to a jackpot trigger occurs, the jackpot amount of coins are paid out to the player. The function of jackpot is as follows: a part of the amount of coins consumed by the player on each slot machine is accumulated as the jackpot amount, and when the jackpot trigger condition is satisfied in one of the slot machines, coins corresponding to the jackpot amount are paid out to the one of the slot machines. In this arrangement, each time the game is executed, the slot machine calculates the amount (accumulative amount) to be added to the jackpot amount, and transmits the accumulative amount to an external controller. The external controller adds the accumulative amount transmitted from each slot machine to the jackpot amount.

<Determination of Effect>

The slot machine produces an effect by displaying an image on a display, outputting light from a lamp, and outputting sound from a speaker. The slot machine samples an effect-use random number and determines the content of an effect based on randomly determined symbols or the like.

(Structure of Control Panel 30)

As shown in FIG. 2, each gaming terminal 10 has a control panel 30 for placing a bet. By operating various buttons of the control panel 30, a player is able to determine a bet amount for a base game.

Figure 3:
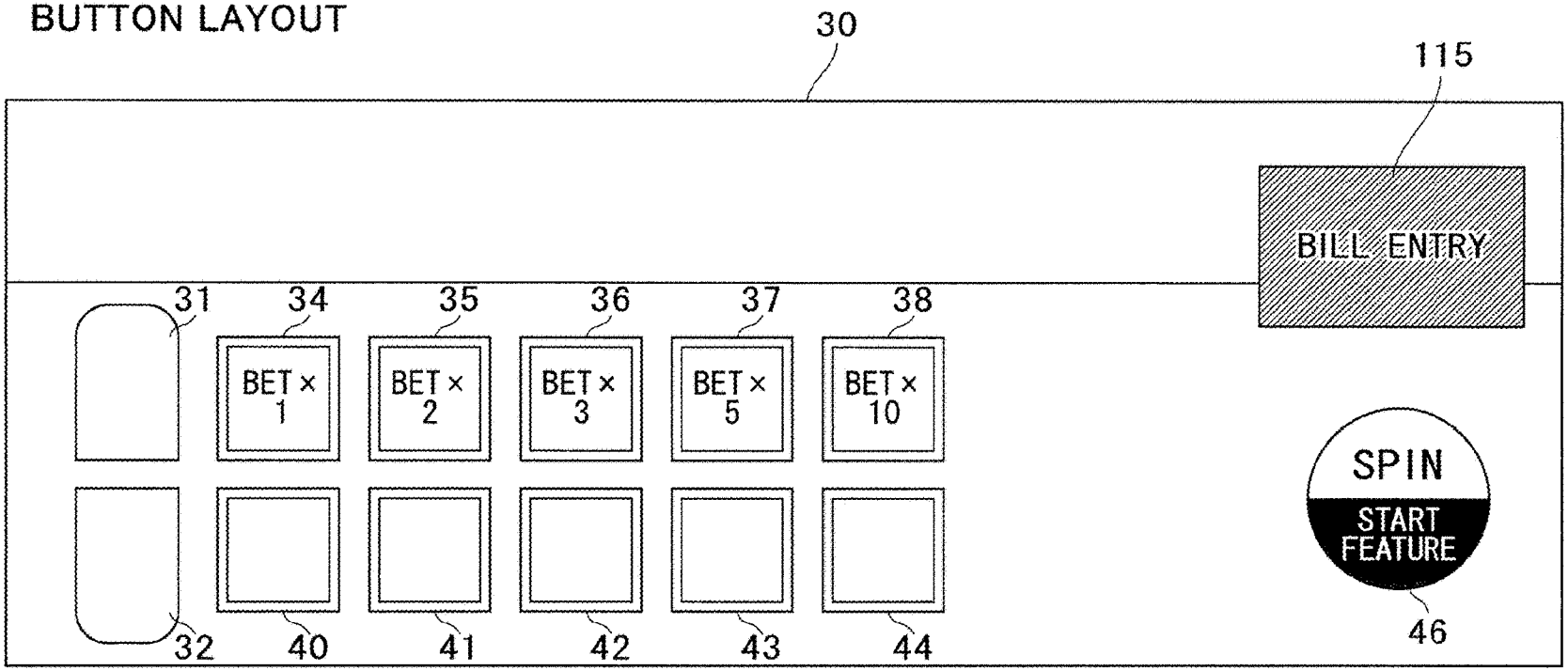
FIG. 3 is a schematic drawing of a control panel.

Specifically as shown in FIG. 3, the control panel 30 includes a CHANGE button 31 and a CASHOUT/TAKE WIN button 32 arranged on the left side area, and a 1-BET button 34, a 2-BET button 35, a 3-BET button 36, a 5-BET button 37, a 10-BET button 38, a first credit button 40, a second credit button 41, a third credit button 42, a fourth credit button 43, and a fifth credit button 44 arranged in the middle area. In addition to the above, on the control panel 30, the bill entry 60 is provided on the upper stage of the right side area, whereas a spin button 46 are provided on the lower stage of the right area.

The change button 31 is an operation button used when a player leaves the machine or when the player requests a staff person of the gaming facility to exchange money. The cashout/take win button 32 is an operation button used when checking out coins (credit) reserved in the slot machine 10 is discharged.

The first credit button 40, the second credit button 41, the third credit button 42, the fourth credit button 43, and the fifth credit button 44 are buttons to determine an area targeted (activated) for winning determination, out of 15 symbol display areas in a matrix of five columns and three rows in which symbols are rearranged. Specifically, when the first credit button 40 is selected, three lines will be the active lines for the winning determination. When the second credit button 41 is selected, nine lines will be the active lines. When the third credit button 42 is selected, 27 lines will be the active lines. When the fourth credit button 43 is selected, 81 lines will be the active lines. When the fifth credit button 44 is selected, 243 lines will be the active lines. In other words, the present embodiment adopts a so-called "LEFT TO RIGHT" type for determination of a winning. The credit buttons 40 to 44 are associated with base bet amounts of 1-credit, 5-credit, 10-credit, 20-credit, and 30-credit, respectively.

As such, the 1-BET button 34, the 2-BET button 35, the 3-BET button 36, the 5-BET button 37, and the 10-BET button 38 are buttons for determining the multiplying factor for a base bet amount. That is, the actual bet amount placed for a slot game will be the product of the base bet amount of a button selected out of the credit buttons 40 to 44 multiplied by the multiplying factor selected out of the BET buttons 35 to 38. It should be noted that the payout of a winning in the slot game will be also multiplied by the multiplying factor. The multiplying factor selected out of the BET buttons 35 to 38 are hereinafter referred to as a multiplier or a bet multiplier, in the following description.

The spin button 46 is a button used for starting the scroll of the video reels. The spin button 46 is a button used for selecting and determining an option out of those displayed on the lower image display panel 141.

As described, the base game is started by operating the spin button 46, after selecting a winning determination target by any of the credit buttons 40 to 44 and selecting the multiplier by any of the BET buttons 35 to 38.

It should be noted that, although the present embodiment adopts a video reel system in which simulated reels are displayed on the lower image display panel 141, the gaming terminal 10 may be provided with a reel unit adopting a mechanical reel system, or may adopt a combination of the video reel system and the mechanical reel system.

[Structures of Circuits Provided to Slot Machine]

Figure 4:
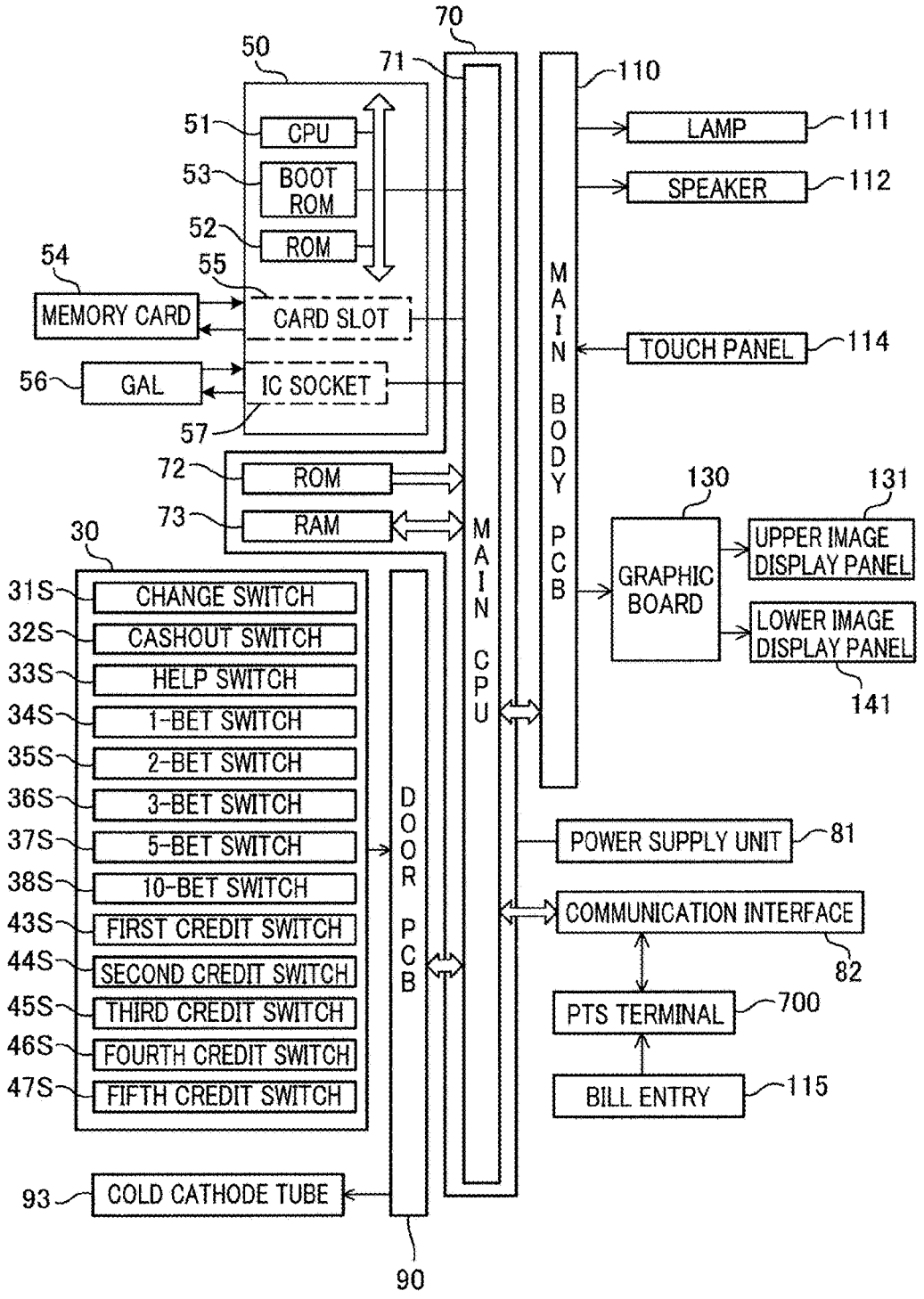
FIG. 4 is a block diagram of a control circuit of a terminal controller.

The following describes a circuitry structure of the gaming terminal 10, with reference to FIG. 4. FIG. 4 is a block diagram showing an internal structure of the slot machine of the embodiment of the present invention.

A gaming board 50 is provided with: a CPU (Central Processing Unit) 51, a ROM (Read Only Memory) 52, and a boot ROM 53, which are mutually connected by an internal bus; a card slot 55 corresponding to a memory card 54; and an IC (Integrated Circuit) socket 57 corresponding to a GAL (Generic Array Logic) 56.

The memory card 54 includes a nonvolatile memory, and stores a game program and a game system program. The game program includes a program related to game progression, a random determination program, and a program for producing effects by images and sounds. Furthermore, the game program includes data defining the arrangement of the symbol array allocated to each video reel 3.

In addition to the above, the card slot 55 is arranged to be receivable the memory card 54, and is connected to a motherboard 70 via an IDE bus.

The GAL 56 is a type of PLD (programmable logic device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI (Peripheral Component Interconnect) bus. The contents and settings of the game to be played on the slot machine 1 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the preliminary authentication program, and the like. The authentication program is a program (falsification check program) for authenticating the game program and the game system program. The pre-authentication program is a program for authenticating the aforementioned authentication program. The authentication program and the preliminary authentication program are written along a procedure (authentication procedure) for proving that the program to be the subject has not been falsified.

The motherboard 70 is provided with a main CPU 71, a ROM 72, a RAM (Random Access Memory) 73, and a communication interface 82. The ROM 72 and the RAM 73 correspond to a storage unit.

The ROM 72 includes a memory device such as a flash memory, and stores a program such as BIOS to be executed by the main CPU 71, and permanent data. When the BIOS (Basic Input/Output System) is executed by the main CPU 71, processing for initializing predetermined peripheral devices is conducted. Further, through the gaming board 50, processing of loading the game program and the game system program stored in the memory card 54 is started.

The controller in the present invention includes the main CPU 71, the ROM 72, the RAM 73, and the memory card 54 storing the game program and the game system program. The controller is configured to control the slot machine by executing the game program and the game system program through the main CPU 71. The controller does not have to be configured as above. It is a matter of course that the configuration may be altered such that the game program and the game system program are stored in the ROM 72 instead of the memory card 54.

The RAM 73 stores data and programs which are used in operation of the main CPU 71. For example, when the processing of loading the aforementioned game program, game system program or authentication program is conducted, the RAM 73 can store the program. The RAM 73 is provided with working areas used for operations when these programs are executed. Examples of the areas include: an area that stores the number of games, the bet amount, the payout amount, the credit amount and the like; and an area that stores symbols (code numbers) randomly determined.

The communication interface 82 is for communicating with the PTS (Player Tracker System) device 700 and the external controller 200. The PTS device 700, upon reception of an input signal from the bill entry 60, transmits credit data contained in the input signal to the main CPU 71 via the communication interface 82. Further, when an IC card is inserted into the card insertion slot, the PTS device 700 transmits credit data stored in the IC card to the main CPU 71 via the communication interface 82. The PTS device 700 also writes credit data into the IC card inserted into the card insertion slot, based on a control signal received from the main CPU 71 via the communication interface 82.

Further, the motherboard 70 is connected with a later-described door PCB (Printed Circuit Board) 90 and a body PCB 110. The motherboard 70 is also connected with a power supply unit 81. When the power is supplied from the power supply unit 81 to the motherboard 70, the main CPU 71 of the motherboard 70 is activated, and then power is supplied to the gaming board 50 through the PCI bus so as to activate the CPU 51.

The door PCB 90 and the body PCB 110 are connected with input devices such as a switch and a sensor, and peripheral devices the operations of which are controlled by the main CPU 71. The door PCB 90 is connected with a control panel 30, a reverter 91, a coin counter 92C and a cold cathode tube 93.

For each of the buttons, the control panel 30 includes: a CHANGE switch 31S, a CASHOUT switch 32S, a HELP switch 33S a 1-BET switch 34S, a 2-BET switch 35S, a 3-BET switch 36S, a 5-BET switch 37S, a 10-BET switch 38S, a first credit switch 40S, a second credit switch 41S, a third credit switch 42S, a fourth credit switch 43S, and a fifth credit switch 44S. Each of the switches outputs a signal to the main CPU 71 upon detection of the pressing of the button corresponding thereto by the player.

The cold cathode tube 93 functions as a backlight installed on the rear face sides of the upper image display panel 131 and the lower image display panel 141, and lights up based on a control signal output from the main CPU 71.

The main body PCB 110 is connected with the lamp 111, the speaker 112, the touch panel 114, the bill entry 115, and a graphic board 130.

The lamp 111 turns on based on a control signal outputted from the main CPU 71. The speaker 112 outputs sounds such as BGM (BackGround Music), based on a control signal outputted from the main CPU 71.

The touch panel 114 detects a place on the lower image display panel touched by the player's finger or the like, and outputs to the main CPU 71 a signal corresponding to the detected place. Upon acceptance of a valid bill, the bill entry 115 outputs to the main CPU 71 a signal corresponding to the face amount of the bill.

The graphic board 130 controls display of images on the upper image display panel 131 and lower image display panel 141, based on a control signal output from the main CPU 71. In the symbol display area 4 of the lower image display panel 141 are displayed five video reels 3, each of which video reels 3 is configured to display the movement of scrolling and stopping the symbol array thereon. The graphic board 130 is provided with a VDP generating image data, a video RAM temporarily storing the image data generated by the VDP, and the like.

The graphic board 130 is provided with the VDP (Video Display Processor) generating image data based on the control signal output from the main CPU 71, a video RAM temporarily storing the image data generated by the VDP, and the like. It is to be noted that the image data used for generating image data by the VDP is included in the game program that has been read from the memory card 54 and stored into the RAM 73.

(Electric Structure of Center Controller 200)

Figure 5:
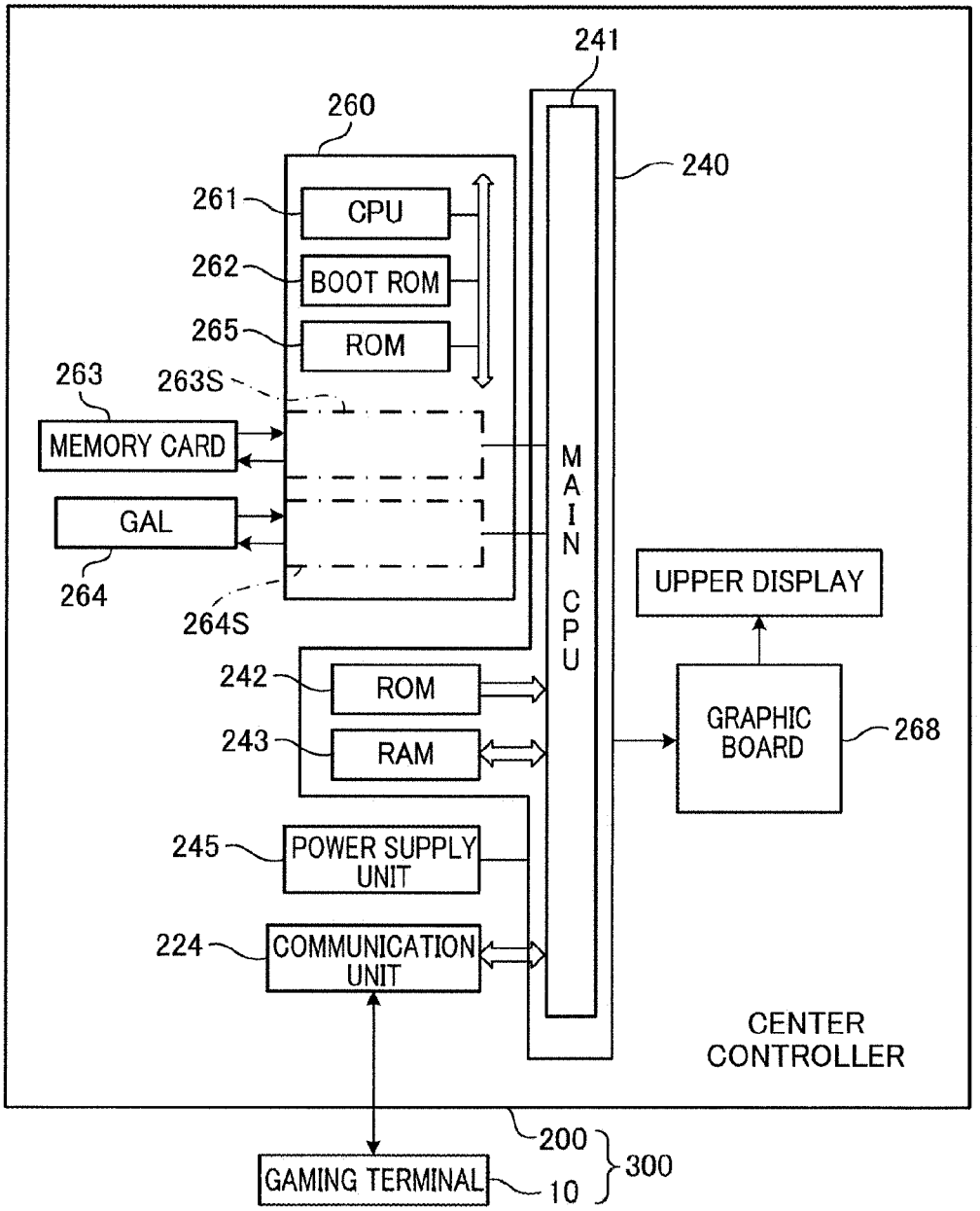
FIG. 5 is a block diagram of a control circuit of a center controller.

FIG. 5 is a block diagram showing an electric structure of the center controller 200. In the center controller 200 is provided a control unit. As shown in FIG. 5, the control unit is provided with a RAM 243 (a memory for storing a bet amount), a motherboard 240, a gaming board 260, and an actuator and the like.

The gaming board 260 has a structure identical to that of the gaming board 50. The motherboard 240 has a structure identical to that of the motherboard 40. The communication unit 224 is for communicating with the gaming terminal 10, through a communication line.

(Link Game)

With the center controller 200 connected to a plurality of gaming terminals 10, it is possible to award a progressive jackpot to the plurality of gaming terminals 10. This system which enables winning of a progressive jackpot is hereinafter referred to a link game. In the link game, the center controller 200 is configured in such a manner as to collect a part of the bet amount every time a bet is placed in any of the gaming terminals 10, for a use as the resource of the progressive jackpot. That is, the center controller 200 function as a progressive controller which manages the amount of the progressive jackpot. The gaming machine 300 of the present embodiment includes four stages of progressive jackpots (GRAND, MAJOR, MINOR, MINI). It should be noted that the progressive jackpot may be hereinafter simply referred to as jackpot.

The function of the center controller 200 as the progressive controller is turned on and off by setting. A difference may be provided in the bet amount, when the function of the progressive controller is on and when it is off. As described hereinabove, the credit buttons 40 to 44 are associated with base bet amounts of 1-credit, 5-credit, 10-credit, 20-credit, and 30-credit, respectively. While the function of the progressive controller is turned on, the credit buttons 40 to 44 are associated with base bet amounts of 6-credit, 10-credit, 15-credit, 25-credit, and 35-credit, respectively. The bet amount is calculated by multiplying any of these values by a multiplier selected by any of the BET buttons 35 to 38.

(Link Game: Internal Processing Overview)

Figure 6:
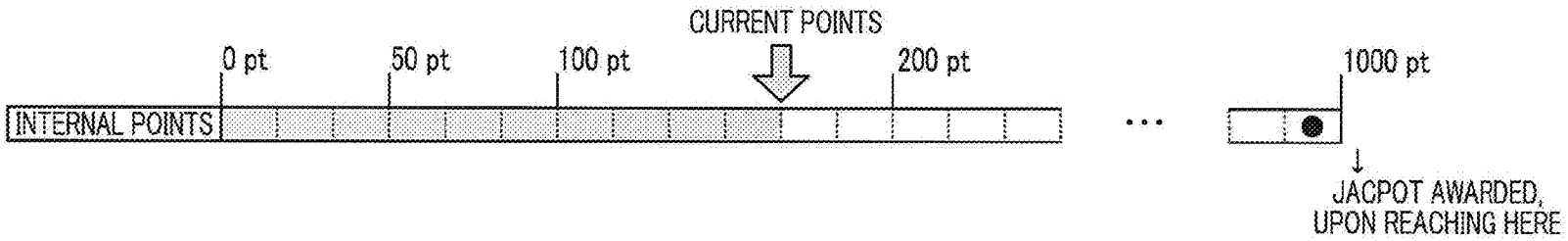
FIG. 6 is an explanatory diagram for a point accumulation.

As shown in FIG. 6, in the link game, each gaming terminal 10 generates a predetermined point value (internal point value) every time it runs a slot game (base game, free game). Further, in the link game, each gaming terminal 10 accumulates point values generated therein. When the accumulated point value reaches a certain value in any of the gaming terminals 10, a jackpot (JP) or a fixed payout is awarded in that gaming terminal 10.

Figure 7:
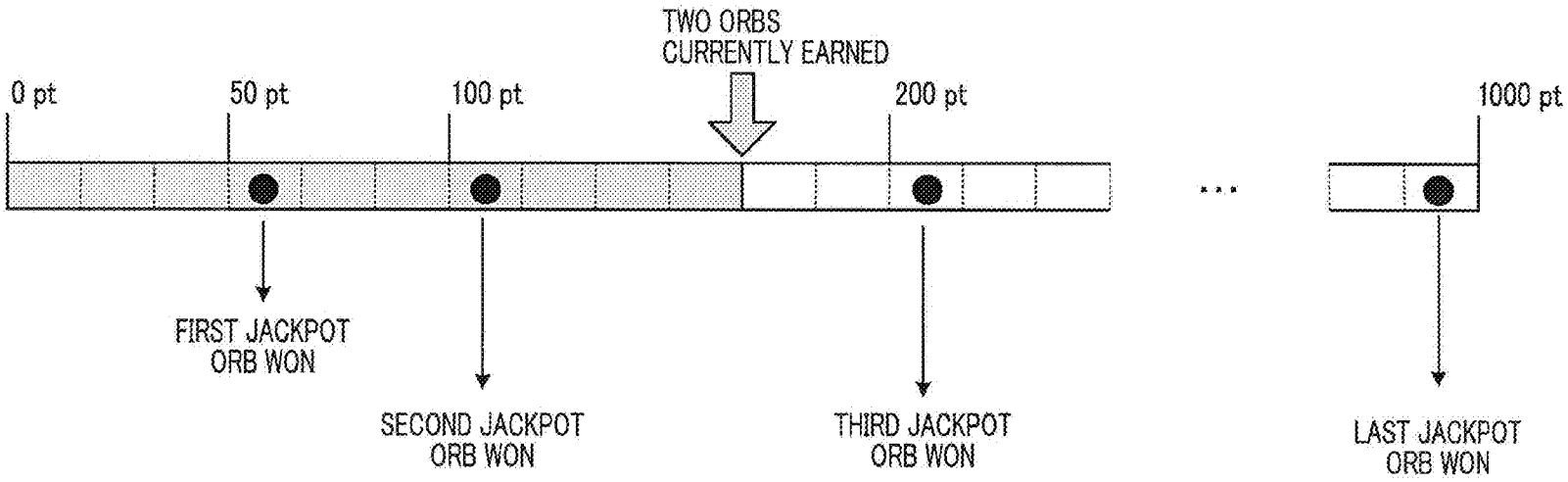
FIG. 7 is an explanatory diagram for a point accumulation.

A little more specifically, as shown in FIG. 7, each gaming terminal 10 accumulates therein a point value according to the bet amount in each game play. There are pre-set point thresholds (50 pt, 100 pt, 200 pt, . . . 1000 pt) to go over before accumulated point value reaches the certain value. Every time the accumulation of the point value reaches any of the pre-set point thresholds, a jackpot orb is won. In some cases, the accumulated point value may exceed more than one pre-set values in a single game play. When the point value is accumulated up to the upper limit, the final jackpot orb is won and a jackpot is won. The accumulated point value is reset at the same time as awarding of the jackpot. The excessive portion of the point value is carried over to the next. The pre-set point thresholds are randomly determined out of a plurality of predetermined patterns. The point value accumulated in each game play is a product of multiplication by a bet multiplier. Therefore, the greater the bet multiplier, the faster the point value is accumulated. It should be noted that the point value is also generated in the free game. The point value in the free game is a product of multiplication by a bet multiplier in the base game having triggered that free game.

The orb (JP orb) is used for an effect indicative of the time taken before awarding of a jackpot. By displaying the orb (JP orb) on the lower image display panel 141 and the like, the time required before awarding of a jackpot is indicated to the player. A credit payout may be awarded in a gaming terminal 10 having won a orb, at the time of winning the orb. This credit payout is preferably not multiplied by a bet multiplier.

Figure 8:
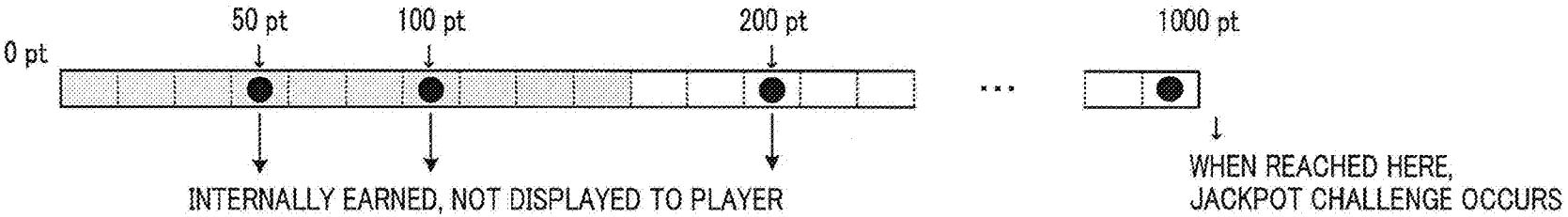
FIG. 8 is an explanatory diagram for a point accumulation.

Further, as shown in FIG. 8, the orb does not necessarily have to be won even when the point value reaches a pre-set point threshold. For example, when the point value reaches a certain value, an effect of jackpot challenge, which indicates winning of a jackpot may be provided.

Figure 9:
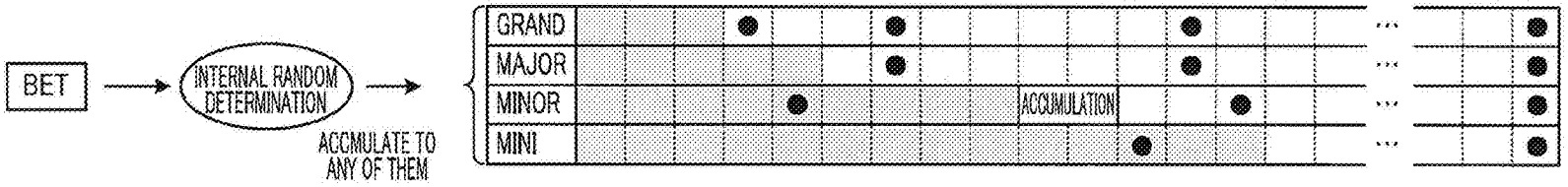
FIG. 9 is an explanatory diagram for a point accumulation.

Further, accumulation of point values is managed for each of the four stages of progressive jackpots (GRAND, MAJOR, MINOR, MINI), as shown in FIG. 9. In other words, each stage of the progressive jackpot has a counter, and an internal random determination is carried out to determine the counter of which stage of jackpot receives the point value generated in a single game play started with a bet. Thus, the point value generated is not sorted into the counters of the multiple stages of the progressive jackpot, and is accumulated in the counter of any one of the stages of the progressive jackpot.

Figure 10:
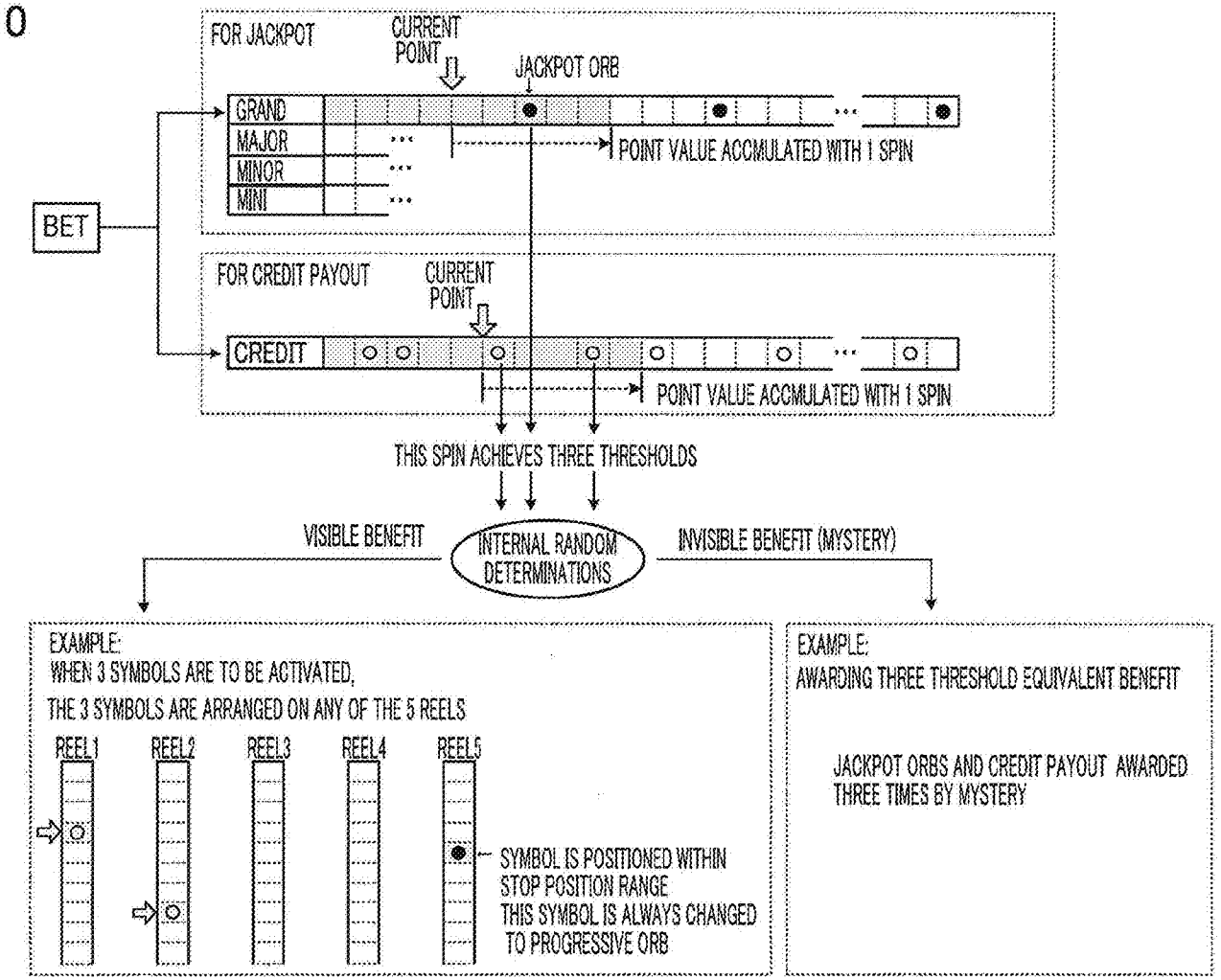
FIG. 10 is an explanatory diagram for a point accumulation.

Further, as shown in FIG. 10, each gaming terminal 10 is configured to accumulate point values for a credit payout, according to the bet amount of each game play. That is, each gaming terminal 10 is configured to accumulate the same point value generated in a counter for a credit payout, and the counter of any one of the stages of the progressive jackpot. For the credit payout counter, pre-set point thresholds are set as in the case of the jackpot orbs. Every time the accumulated point value in the credit payout counter reaches a pre-set point threshold, a credit payout is awarded.

A predetermined effect may be provided at a time of awarding a credit payout. For example, when awarding of a credit payout is determined, a specific symbol (overlap symbol) may shown on a variably displayed symbol array. Alternatively, the payout may be awarded as a mystery which does not involve an effect. Further, an internal random determination may be carried out to determine which one of the above will be executed. Further, a random determination may be carried out when the accumulated point value reaches a pre-set point threshold, to determine whether to award a credit payout. Meanwhile, if winning of the jackpot challenge or winning of a jackpot orb is determined, a random determination is carried out to determine whether to execute an effect of the specific symbol appearing or to award the payout as a mystery. To execute the effect of causing the specific symbol to appear, one or more exclusive symbol arrays with a certain number of specific symbols depending on the number of pre-set point thresholds achieved (hereinafter, referred to as achieved point thresholds) are variably displayed. When the symbol arrays are stopped, a credit payout or a loss is awarded according to the specific symbols in the symbol display area. In cases of a mystery payout, the credit payouts won are awarded one by one at each mystery. Mystery does not include a loss. For each credit payout won, the random determination is carried out to determine whether to cause the specific symbol to appear or to execute the mystery. Therefore, both the effect and the mystery may take place if a plurality of credit payouts are won for a single occurrence of a point value.

Figure 11:
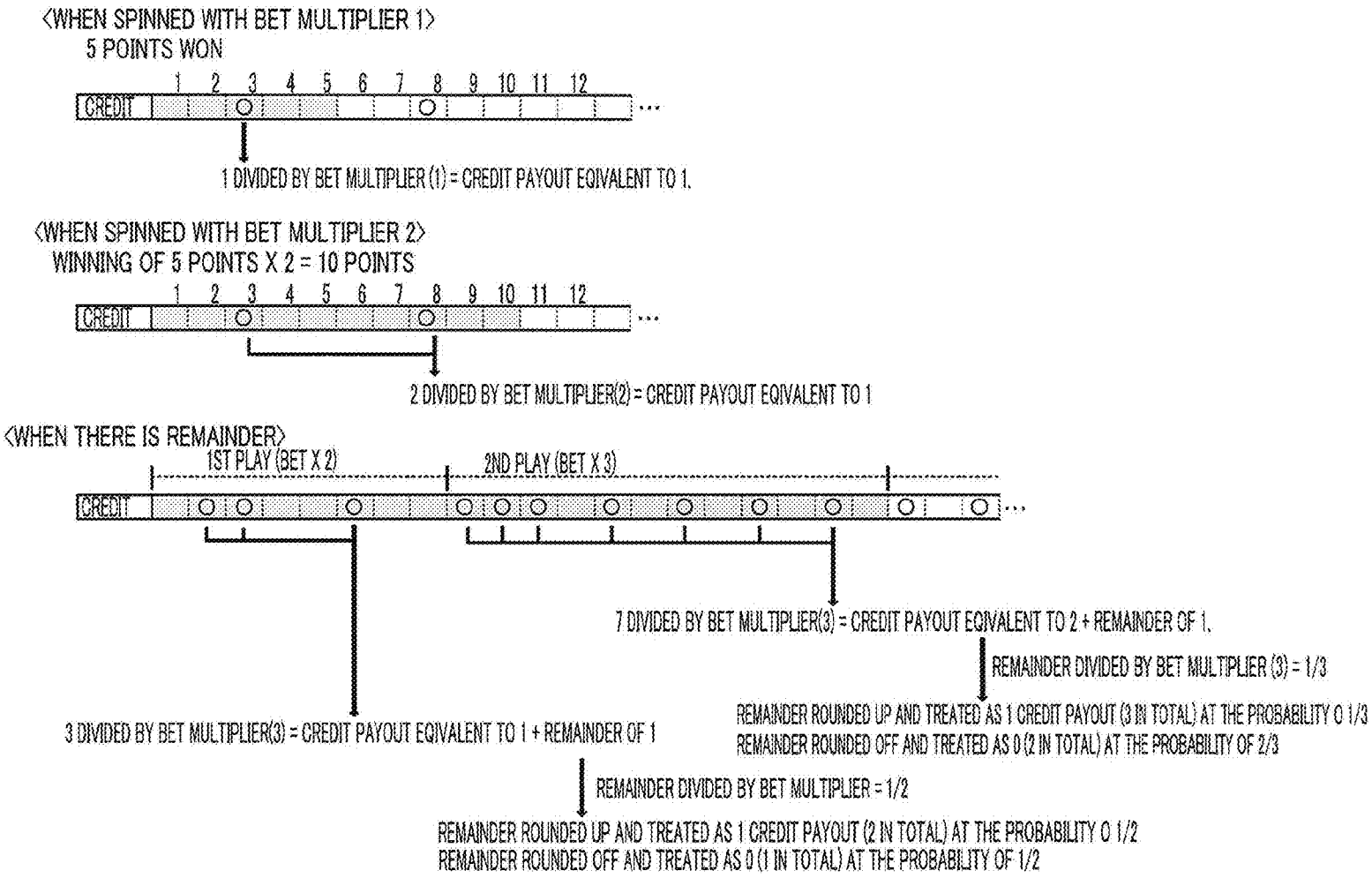
FIG. 11 is an explanatory diagram for a point accumulation.

As shown in FIG. 11, a value resulting from multiplication of the basic point value by a bet multiplier is accumulated. When the number of achieved point thresholds is the number of bet multipliers, it is considered as one credit payout, and a random determination for the effect is executed. The amount of credit payout is rounded up or rounded off at predetermined probabilities. The credit amount paid out is a value resulting from a multiplication by the bet multiplier.

(Link Game: Internal Processing Overview; Festival Mode)

Figure 12:
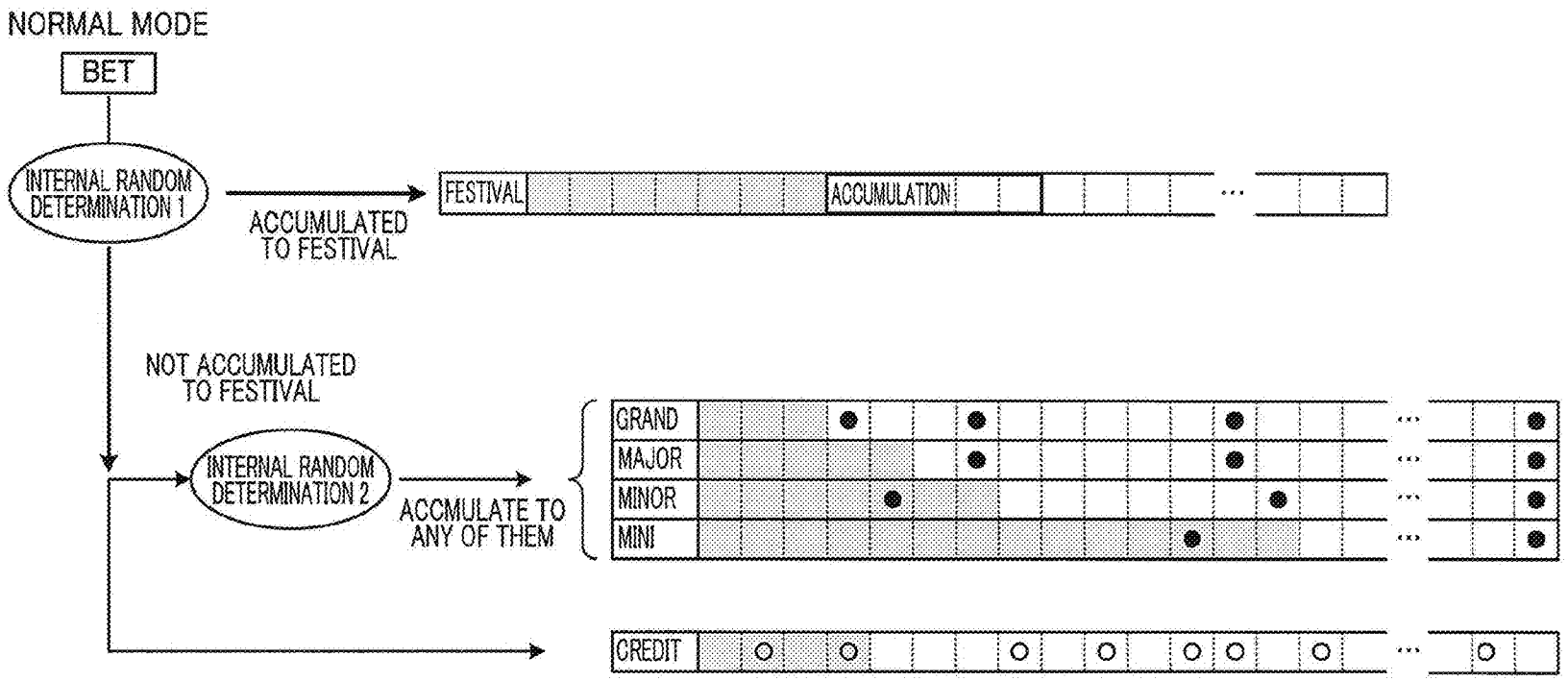
FIG. 12 is an explanatory diagram for a point accumulation.

In addition to the counters for jackpots, the counter for the credit payout, there is a counter for the festival mode (hereinafter, festival mode counter), as shown in FIG. 12. While the game is played in the normal state, there is always carried out a random determination to determine whether to accumulate the generated point value to the festival mode counter. If it is determined that the point value is not to be accumulated in the festival mode counter, the same point value is accumulated in both the jackpot counter and the credit counter. Further random determination is carried out to determine which one fo the stages of the jackpot counter the point will be accumulated.

The accumulated point value in the festival mode counter is used in a gaming state referred to as festival mode, which is separate from the normal mode. The festival mode is initiated by the center controller 200 having received a signal from the gaming terminal 10. Namely, when the game play count of a gaming terminal 10 reaches a certain value, the terminal transmits a signal to the center controller 200. The center controller 200, upon reception of the signal from a gaming terminal 10, causes transition of the gaming status from the normal mode to the festival mode, in any gaming terminal 10 which meets a condition. This condition is that a game is being played on the gaming terminal 10, when the festival mode is triggered.

Figure 13:
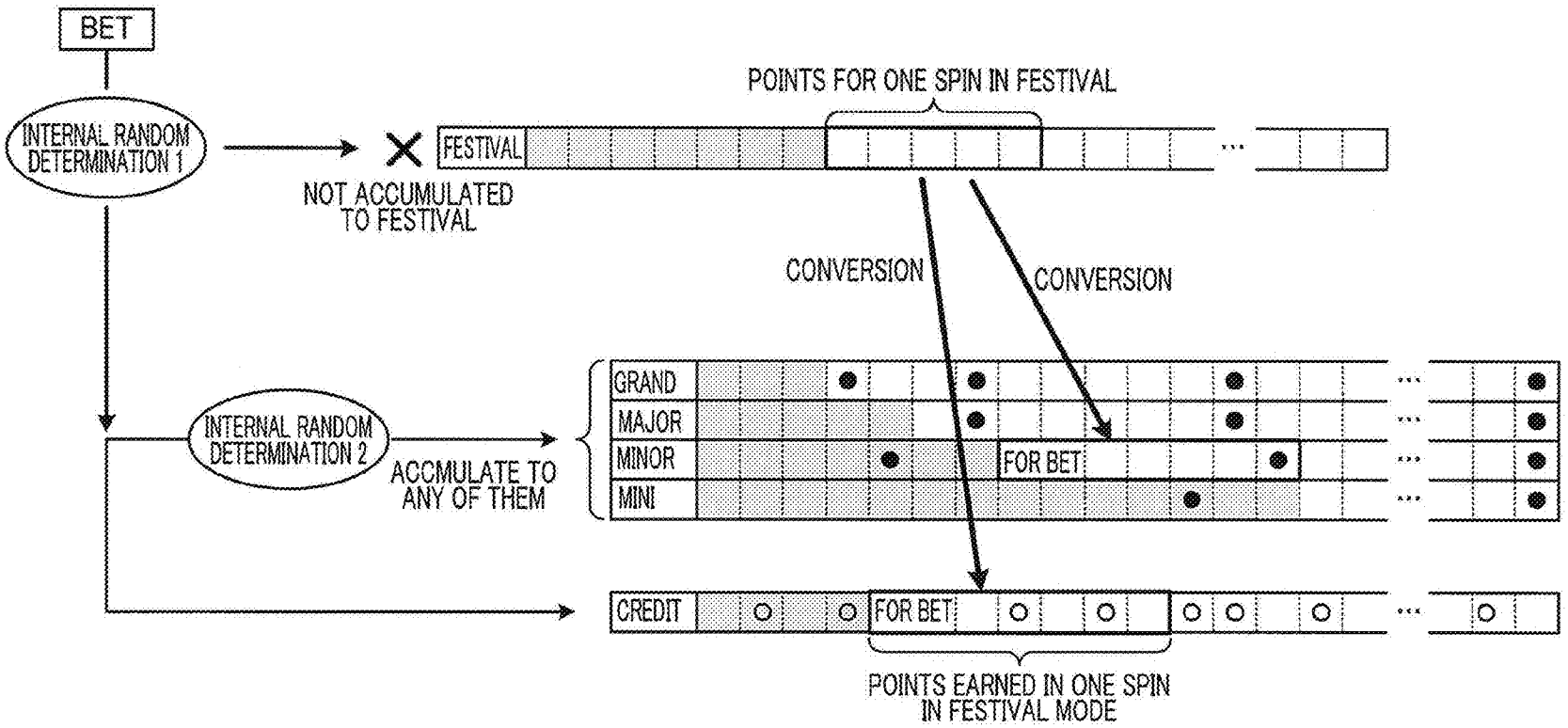
FIG. 13 is an explanatory diagram for a point accumulation.

As shown in FIG. 13, accumulation of generated point values in the festival mode is different from that in the normal state. Specifically, the point values generated will not be accumulated in the festival mode counter, and will be only accumulated in the jackpot counter and the credit counter. Further, the accumulated point value in the festival mode counter is transferred (converted) to the jackpot counter and the credit counter. The point value transferred is a value resulting from multiplication by a bet multiplier.

The festival mode lasts a predetermined period (3 minutes). The point value of the festival mode counter not transferred during this period may be carried over to the next festival mode. That is, the point value of the festival mode counter is maintained as it is.

Example cases where a festival point value is not converted during the festival mode include: a gaming terminal 10 which was not played at the time when the festival mode was triggered (non-eligible gaming terminal 10); a gaming terminal 10 in which the festival point value at the time when the festival mode was triggered was 0; and a gaming terminal 10 in which the festival point value in the festival counter became 0 during the festival mode. When a game is played in the festival mode in the above cases, the conversion of a point value in the festival counter does not take place; however, the internal random determination is switched to that of the festival mode. Specifically, examples of internal random determination switched are: the random determination for determining whether to accumulate a point value to the festival counter (probability becomes 0, and point value is no longer accumulated to the festival counter); the random determination for determining the credit payout; and the random determination for determining whether to execute an effect involving the specific symbol or to make the credit payout a mystery, at the time of awarding the payout. Further, as an example of a random determination taking place only in the festival mode is one for determining not to execute the effect involving the specific symbol when the payout amount is 0 credit.

(Link Game: Details of Internal Processing: Data Table of Gaming Terminal 10)

The following describes the details of the internal processes related to the link game. First described are various tables stored in the RAM73 of the gaming terminal 10.

(Point Management Table)

As shown in FIG. 14, the accumulated point values of the festival counter, the jackpot counter, and the credit counter described hereinabove are managed by a point management table. The point management table stores the point values of the festival mode, the first progressive (GRAND), the second progressive (MAJOR), the third progressive (MINOR), the fourth progressive (MINI), and the credit. A point value is generated in the gaming terminal 10, and the point management table is updated every time the point value generated are distributed. Further, every time the point management table is updated, there is determined whether or not any of the point values of the festival mode, the first progressive (GRAND), the second progressive (MAJOR), of the third progressive (MINOR), the fourth progressive (MINI), and the credit have reached the pre-set point threshold, or a certain value.

(Base Game Point Random Determination Table)

As shown in FIG. 15, a basic point value generated in each play of the base game is determined through random determination using a base game random determination table. It should be noted that SC01 to SC16 are setting values, and any of these set in advance are used. For example, in the case of SC01, a weight of 6 is stored for the point value of 7, and a weight 4 for the point value of 6. Of the total value of weight ranging from 0 to 9, the main CPU 70 of the gaming terminal 10 sets 0 to 5 as a non-winning range (weight 6) and sets 6 to 9 as the winning range (weight 4). A random number is extracted out by the main CPU 70, out of the total weight value range of 0 to 9. If the random number extracted falls within a range of 0 to 5, the main CPU 70 determines 7 as the point value to be generated. If the random number extracted is 6, the point value to be generated is determined to be 6.

(Free Game Point Random Determination Table)

As shown in FIG. 16, a basic point value generated in each play of the free game is determined through random determination using a free game random determination table. The point value in the free game is determined in the similar manner to the determination of the point value in the base game. It should be noted that V01, V02, V03, V04, and V05 in FIG. 16 are setting values.

(Festival Point Sorting Random Determination Table)

As shown in FIG. 17, whether to accumulate the point value generated as the festival point is determined through random determination using a festival point sorting random determination table. If the point value is not to be accumulated as the festival points, the point value is to be accumulated as the jackpot points or the credit points.

(Jackpot Point Sorting Random Determination Table)

As shown in FIG. 18, if the point value generated is not to be accumulated as the festival points, random determination is carried out, using the jackpot point sorting random determination table, to determine in which one of the jackpot stages, the point value generated is accumulated.

(Progressive Pre-Set Point Threshold Setting Table)

As shown in FIG. 19, in a first progressive pre-set point threshold setting table, pre-set point thresholds are set in relation to accumulation of the first progressive point values. That is, the first progressive pre-set point threshold setting table contains pre-set values of the accumulated first progressive point values, each of which serves as a threshold of winning an orb.

Similarly, in a second progressive pre-set point threshold setting table, a third progressive pre-set point threshold setting table, and a fourth progressive pre-set point threshold setting table shown in FIG. 20 to FIG. 22, respectively, pre-set point thresholds are set in relation to accumulation of the second progressive pre-set point threshold setting table, the third progressive pre-set point threshold setting table, and the fourth progressive pre-set point threshold setting table, respectively. In FIG. 19 to FIG. 22, each of numbers (Nos.) corresponding to weights for random determination indicates the progressive pre-set point thresholds for the first orb to JP orb winnings.

(Credit Payout Random Determination Table for Occasion of Winning Orb)

As shown in FIG. 23, a credit payout random determination table for an occasion of winning an orb is used for determining a credit payout which is awarded when an orb is won by achieving any of the pre-set point thresholds shown in FIG. 19 to FIG. 22. It should be noted that this credit payout is not a value resulting from multiplication by a bet multiplier, and the credit payout determined by using the credit payout random determination table for an occasion of winning an orb is awarded as it is.

(Credit Payout Time Effect Random Determination Table)

As shown in FIG. 24, a credit payout time effect random determination table is used for determining an effect for a time of credit payout.

(Normal State Credit Point Payout Random Determination Table)

As shown in FIG. 25, a normal state credit point payout random determination table is used for determining a credit payout when the credit point value is accumulated up to any one of the pre-set point thresholds during a normal state. It should be noted that V01, V02, V03, V04, V05, and V06 in FIG. 25 are setting values.

(Festival Mode Credit Point Payout Random Determination Table)

As shown in FIG. 26, a festival mode credit point payout random determination table is used for determining a credit payout when the credit point value is accumulated up to any one of the pre-set point thresholds during the festival mode. It should be noted that V01, V02, V03, V04, V05, and V06 in FIG. 26 are setting values.

It should be noted that in the credit point value, the pre-set point thresholds are modified as follows according to the setting values. Namely, when the setting value is SC01 to SC04, the pre-set point threshold is set at every 7 points. Further, when the setting value is SC05 to SC08, the pre-set point threshold is set at every 6 points. Further, when the setting value is SC09 to SC12, the pre-set point threshold is set at every 5 points. Further, when the setting value is SC13 to SC16, the pre-set point threshold is set at every 4 points. Further, an effect by the specific symbols is always provided, when the random determination using the credit point payout random determination table results in a payout amount of 0. Further, a random determination of an effect using the credit payout time effect random determination table shown in FIG. 24 is carried out, when the random determination using the credit point payout random determination table results in a payout amount of anything other than 0.

It should be noted that a change to the mystery effect occurs, when the number of the specific symbols (overlap symbols) to be arranged on the symbol arrays are too many. In other words, the positions on the symbol arrays for arranging the overlap symbols, which leads to progressive challenge or a progressive, is limited within the symbol display frame where symbols stops. However, according to the playing condition, overlap symbols which leads to credit payout could be positioned throughout the entire symbol display frame. In such an event, there will be no space for arranging an overlap symbol leading to the progressive challenge. Therefore, the following restriction is provided, and a change to a mystery will take place. Namely, when the overlap symbols to be arranged on the symbol arrays and the overlap symbols leading to the progressive challenge or a progressive orb sums up to more than 15, the progressive challenge or the progressive orb are all changed to a payout by the mystery.

(Link Game: Details of Internal Processing: Data Table of Center Controller 200)

Next, the following describes various tables and the like stored in the RAM243 of the center controller 200.

(Festival Mode) The festival mode is started by the center controller 200, when the game play count of any of the gaming terminals 10 reaches a certain value. That is, each gaming terminal 10 makes a transition to the festival mode upon reception of a trigger signal from the center controller 200. However, when it is determined that the game is not played in any of the gaming terminals 10 at the time of receiving the trigger signal from the center controller 200, the transition to the festival mode is stopped in that gaming terminal 10. The condition for determining that the game is being played includes the game is currently running, or the time elapsed from the last play of the game is within 10 seconds. The festival mode ends upon elapse of a certain period (3 minutes).

As described hereinabove, in the festival mode, the festival point value is converted to any of the progressive points, and the credit points. Specifically, in a gaming terminal 10 during the festival mode, a predetermined value of points (40 points) in each game run is multiplied by a bet multiplier of the game running, and the resulting value is the value of the points after conversion. It should be noted that, if the festival point value is less than the predetermined points, the entire festival points are converted.

Further, it should be noted that, whether to provide the effect for paying out at the time of winning a credit payout during the festival mode is randomly determined with a weight of 72 for the overlap symbols and a weight of 928 for no effect, when the credit payout amount is 0. When the credit payout amount is anything other than 0, the random determination is carried out with a weight of 494 for the overlap symbols, and a weight of 131 for the mystery. Further, whether to provide an effect of paying out at the time of winning an orb during the festival mode is randomly determined with a weight of 494 for the overlap symbols, and a weight of 131 for the mystery.

(Game Play Count Random Determination Table)

As shown in FIG. 27, the game play count of each gaming terminal 10 for starting the festival mode is randomly determined by using a game play count random determination table. To each of the 11 game play counts stored in the game play count random determination table, the same weight is associated, and any one of the game play counts is randomly determined. It should be noted that the average of the 11 game play counts is 3000. The random determination using the game play count random determination table is carried out at the time of starting the festival mode.

(Game Play Count Management Table)

The game play count management table as shown in FIG. 28 is used for managing the game play counts. Each gaming terminal 10 transmits to the center controller 200 a game start signal containing the identification information of that gaming terminal 10, every time a game is run. The center controller 200, upon receiving the game start signal, increments by 1 the game play count of that gaming terminal 10 having transmitted the game start signal. The game play counts of all of the gaming terminals 10 in the game play count management table is reset, when the festival mode occurs. Counting of the game play counts for the subsequent festival mode takes place even during the festival mode.

(Increment Rate Table)

FIG. 29 illustrates a progressive increment rate table which stores increment rates for the four stages of progressive jackpots. Every time a bet is placed on the gaming terminal 10, the increment rate of the bet amount is added to each of the four stages of the progressive jackpots. It should be noted that the progressive1, the progressive2, the progressive3, and the progressive4 in the table corresponds to the progressive jackpots of GRAND, MAJOR, MINOR, and MINI, respectively. Further, the upper limit value of the progressive1 is $99,999,999,999.99, the upper limit value of the progressive2 is 999, 999, 999.99, the upper limit value of the progressive3 is 99, 999, 999.99, and the upper limit value of the progressive4 is 99, 999, 999.99.

(Base Value Setting Table)

FIG. 29 illustrates a base value setting table which stores base values for the four stages of progressive jackpots. In each of the gaming terminals 10, the four stages of the progressive jackpots are incremented every time a bet is placed, starting from their corresponding base values stored in the base value setting table as their initial values.

(Process Operations of Center Controller 200: Festival Mode Management Process)

Figure 31:
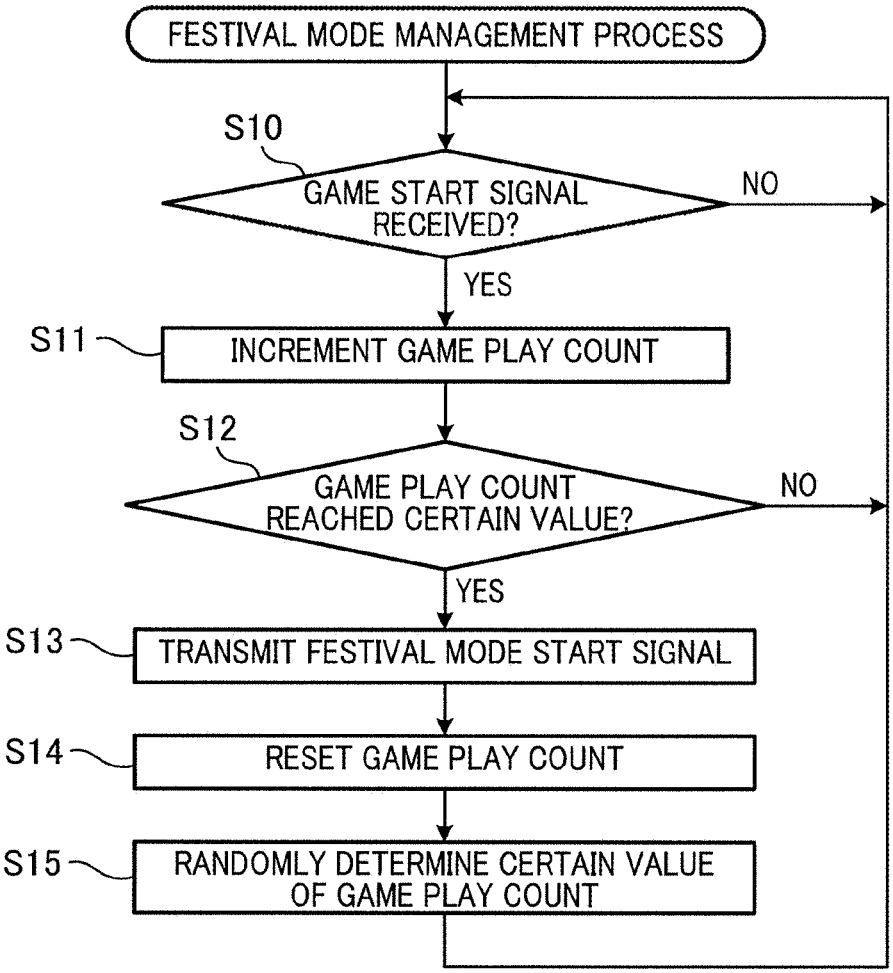
FIG. 31 is a flowchart of a festival mode management process.

The following describes a festival mode management process executed by the main CPU 241 of the center controller 200, with reference to FIG. 31.

First, the main CPU 241 determines whether or not a game start signal is received from any of the gaming terminal 10 (S10). If no game start signal is received (S10: NO), the main CPU 241 returns to the step of S10. If a game start signal is received on the other hand (S10: YES), the main CPU 241 increments by 1 the game play count of the gaming terminal 10 indicated by the game start signal, in the game play count management table (see FIG. 28) (S11). Then, the main CPU 241 determines whether the game play count of that gaming terminal 10 has been incremented to reach a certain value (S12). If the game play count has not yet reached the certain value (S12: NO), the main CPU 241 returns to the step S10.

On the other hand, if the game play count has reached the certain value (S12: YES), the main CPU 241 transmits a festival mode start signal to all of the gaming terminals 10 (S13). It should be noted that each gaming terminal 10 having received the festival mode start signal determines whether or not it has satisfied the festival mode start condition, and starts the festival mode if the festival mode start condition is satisfied.

After the step S13, the main CPU 241 resets the game play counts of all the gaming terminals 10 in the game play count management table (see FIG. 28) (S14). Then, the main CPU 241 determines a value of the game play count as the certain game play count for the subsequent festival mode, referring to the game play count random determination table (see FIG. 27), and store the value in the RAM243 and the like. Then, the main CPU 241 returns to step S10.

(Process Operation of Gaming Terminal 10: Point Process)

Figure 32:
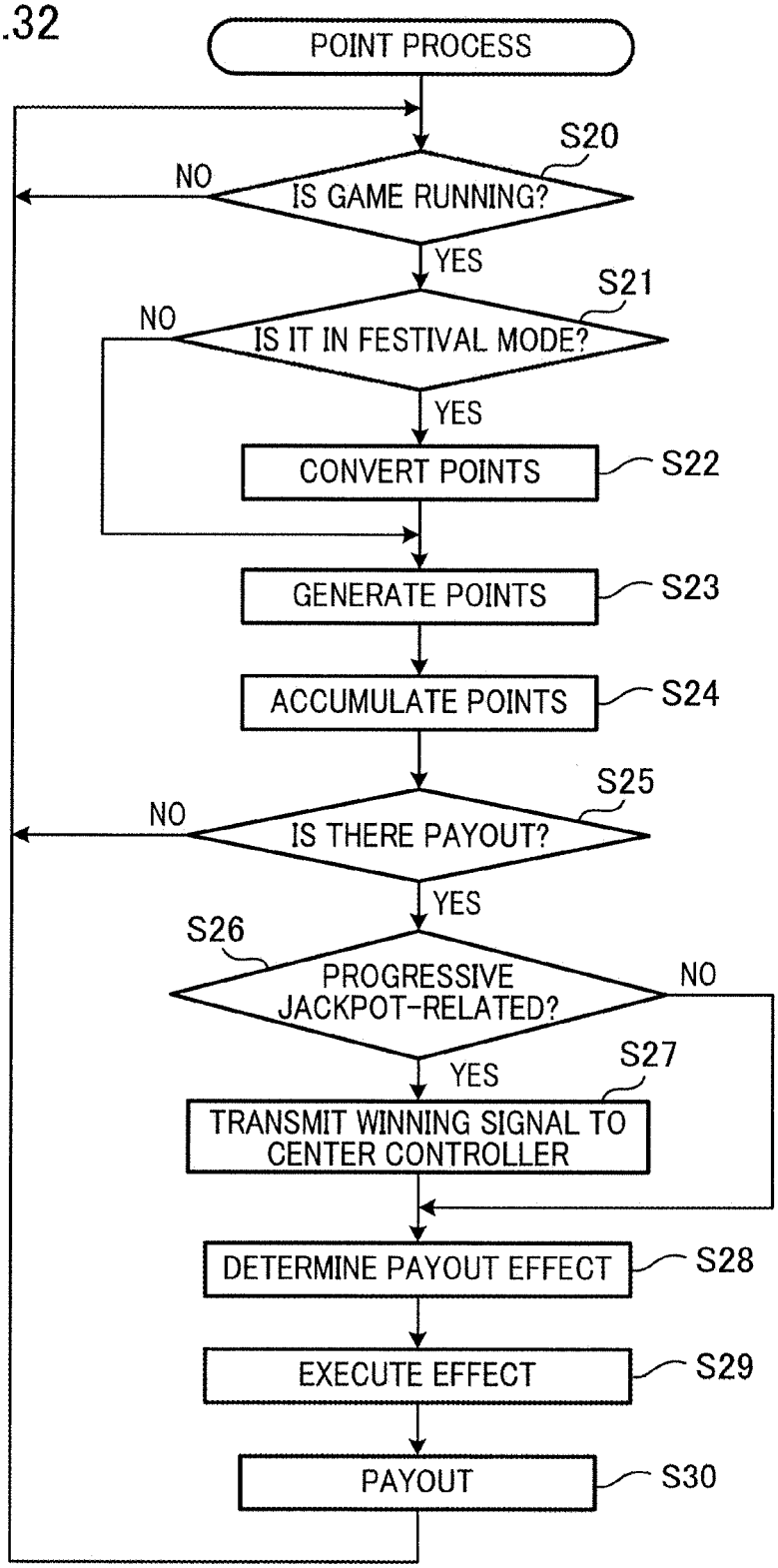
FIG. 32 is a flowchart of a point process.

The following describes a point process executed by the main CPU 71 of the gaming terminal 10, with reference to FIG. 32.

First, the main CPU 71 determines whether or not a game is run (S20). If the game is not run (S20: NO), the main CPU 71 returns to the step S10. If the game is run on the other hand (S20: YES), the main CPU 71 determines whether or not the festival mode is active (S21). If the festival mode is active (S21: YES), the main CPU 71 converts a predetermined value out of the festival point value (S22). It should be noted that, in the conversion of the point value, the main CPU 71 subtract the predetermined value from of the festival point value, and multiplies the predetermined value by the bet multiplier of the game running. Then, the resulting value is added to the jackpot points and the credit payout points. It should be noted that the jackpot point sorting random determination table is used for randomly determining the point value is added to the jackpot points of which one of stages of the progressive jackpots (see FIG. 18).

If the festival mode is not active (S21: NO) in the step S21, or after the step S22, the main CPU 71 generates a point value (S23). It should be noted that, in regard to point generating process, the main CPU 71 determines the base point value by referring to the base game point random determination table (see FIG. 15) for the base games, and refers to the free game point random determination table (see FIG. 16) for the free games. Then, in the base game, the main CPU 71 muliplies the base point value by a bet multiplier of the base game, and in the free game, multiplies the base point value by the bet multiplier of the base game having triggered the free game. Then, the resulting value is determined as the point value to be added.

After that, the main CPU 71 accumulates the point value determined (S24). If the festival mode is determined as to be active in the step S21, the main CPU 71 accumulates the point value determined to the jackpot points and the credit payout points. If the festival mode is determined as to be inactive in the step S21, the main CPU 71 determines whether to add the point value to the festival mode points or to both the jackpot points and the credit payout points, by referring to the festival point sorting random determination table (see FIG. 17). It should be noted that the jackpot point sorting random determination table is used for randomly determining the point value is added to the jackpot points of which one of stages of the progressive jackpots (see FIG. 18).

Then, the main CPU 71 determines if any of the festival mode point value, the jackpot point value, and the credit payout point value have reached a certain value or any of the pre-set point thresholds, leading to awarding of a payout (S26). If there is no payout (S25: NO), the main CPU 71 returns to the step S20. On the other hand, if there is a payout (S25: YES), the main CPU 71 determines whether the payout is a progressive jackpot (S26). If the payout is a progressive jackpot (S26: YES), the main CPU 71 transmits a winning signal indicative of the stage of the progressive jackpot won to the center controller 200 (S27). The center controller 200, upon reception of the winning signal, transmits the current value of that stage of the progressive jackpot to the gaming terminal 10 having won the progressive jackpot, and initializes the value in the base value setting table (see FIG. 30) of that stage of the progressive jackpot.

If the payout is determined as not to be a progressive jackpot in the step S26 (S26: NO), or after the step S27, the main CPU 71 determines the effect for awarding the payout, by referring to various effect random determination table (S28). After that, the main CPU 71 executes the effect determined in the step S28 (S29), awards the payout (S30), and then returns to the step S20.

As hereinabove described, the gaming machine 300 of the present embodiment includes gaming terminals 10; storage devices such as a RAM73 of each of the gaming terminals 10 and a RAM243 of the center controller 200, which store the game play counts and the point values generated in the games run in the gaming terminals 10; and the center controller 200 configured to award a benefit to the gaming terminals 10.

In the gaming machine 300, the center controller 200 executes a process of storing, in the storage device such as the RAM243 of the center controller 200 and the like, the total game play counts of the gaming terminals 10, each of which counts is incremented at each play of the game.

Further, in the gaming machine 300, each gaming terminal 10 executes a process of storing a portion of the total point value as the festival mode points in the point management table stored in the RAM73, and stores the remaining portion of the point value as any of the first to the fourth progressive points and as the credit points in the point management table.

Further, in the gaming machine 300, the center controller 200 executes a process of transmitting a festival mode start signal to the gaming terminals 10, when the total game play count of any of the gaming terminals 10 stored in the game play count management table in the RAM243 reaches a certain value. Each of the gaming terminals 10 having received the festival mode start signal starts the festival mode, and executes a process of adding the point value stored as the festival mode points in the point management table to any of the first to fourth progressive points as well as to the credit points, which are stored in the point management table.

Further, when the total point value of any of the first to fourth progressive jackpots in the point management table reaches a certain point value in the gaming machine 300, the center controller 200 executes a process of awarding the progressive jackpot managed by the center controller 200 to the gaming terminal 10.

(Link Game: Effect Process Overview)

Figure 33:
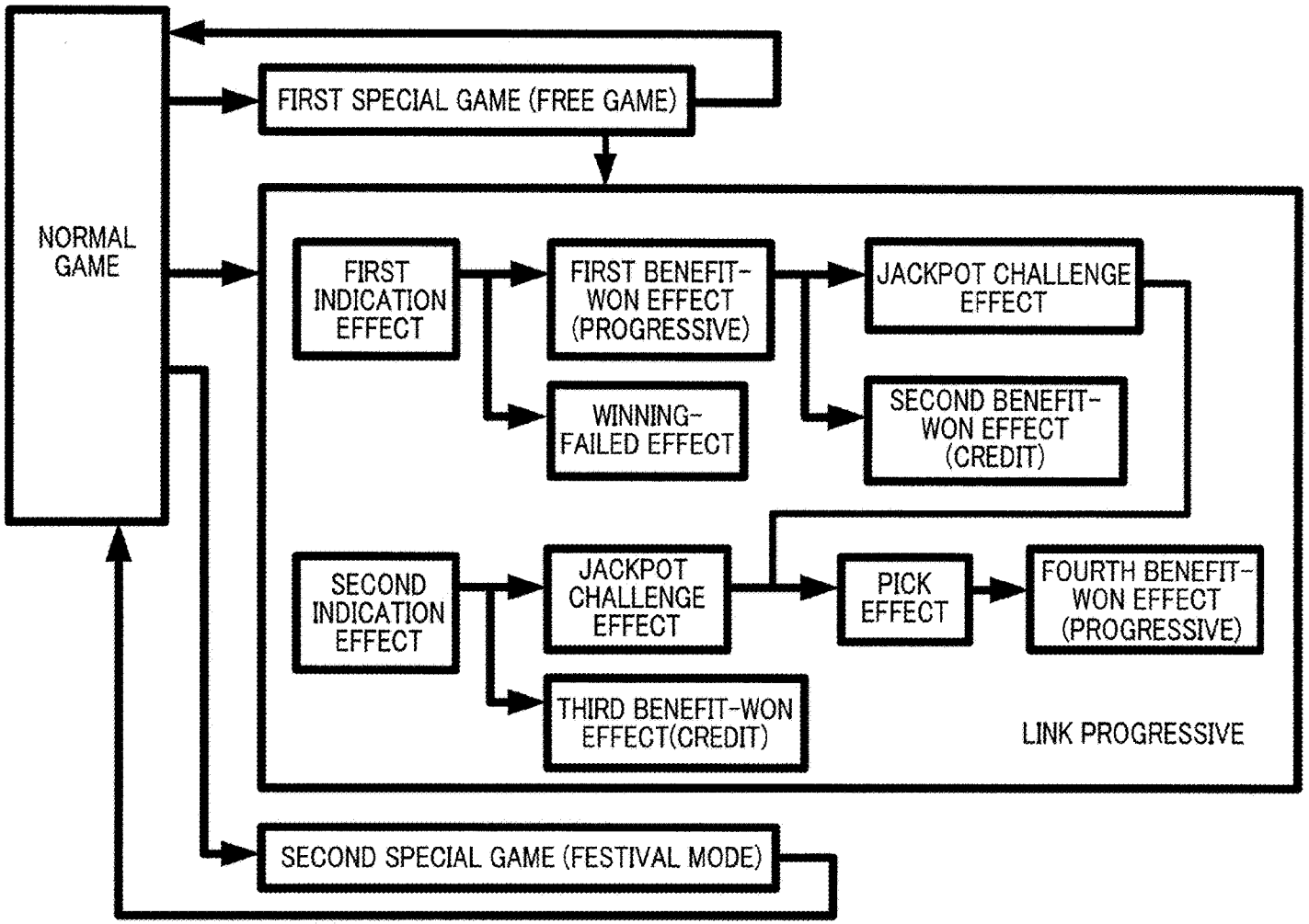
FIG. 33 is a flow of an overall effect process.

As shown in FIG. 33, the slot game of the present embodiment includes a normal game which is the base game, a first special bonus (free game), a link progressive, and a second special bonus (festival mode).

When the free game symbol stops in three positions from the left in the symbol display frame during the normal game, the gaming state transits to the free game. In the free game, when an overlap symbol "firecracker decoration" stops on the screen, or when an "antique coin" appears, a random determination related to the link progressive is carried out, similarly to the base game. The gaming state returns to the normal game upon ending of the free game.

In the normal game or the free game, when a overlap symbol "firecracker decoration" stops on the screen (first indication effect), or when an "antique coin" appears (second indication effect), a random determination related to the link progressive is carried out. It should be noted that the link progressive includes four stages of link progressives (i.e., MINI, MINOR, MAJOR, GRAND). Every bet commonly has a chance of winning the four stages of progressives.

When the gaming state enters the link progressive, the first indication effect is provided which is for enhancing the player's expectation and is such that the overlap symbol of "fire cracker decoration" is displayed on the reels, and an animation of the fire burning along the fuse is displayed within a short period after all the reels are stopped.

After the first indication effect, if the winning-failed effect such that the fire extinguishes in the middle of the fuse, failing to explode the firecrackers, is executed, nothing is won. After the first indication effect, if a first benefit-won effect (progressive) such that a lit bundle of firecrackers, while cracking, moves towards the center, leading to animation of the firecrackers jumping out is displayed, a credit or a link progressive is obtained.

After the first benefit-won effect, there is executed a jackpot challenge effect such that a flashy explosion occurs at the center of the lower image display panel 141, a logo of the jackpot challenge appears, and fireworks explode on the upper image display panel 131. After the jackpot challenge effect, there is carried out a pick effect such that the firecrackers explode and percussion instruments as picks appear. When a percussion instrument is picked, there is carried out a fourth benefit-won effect such that festival icons corresponding to the different levels of progressives appear, and then the first-appeared four levels of progressives are obtained.

After the first benefit-won effect, there is carried out a second benefit-won effect such that a firework ball largely curves and explode on the lower image display panel 141. Then, a credit is displayed and the credit is won.

When the gaming state enters the link progressive, if the second indication effect such that antique coins fall from the top of the upper image display panel 131 is carried out, a third benefit-won effect of flashing the antique coins is carried out. Then, a credit is displayed and the credit is won. After the second indication effect and flashing of the antique coins, there is carried out a jackpot challenge effect of displaying a logo of the jackpot challenge. Then, there is carried out a pick effect such that the firecrackers explode and percussion instruments as picks appear. When a percussion instrument is picked, there is carried out a fourth benefit-won effect such that festival icons corresponding to the different levels of progressives appear, and then the first-appeared four levels of progressives are obtained.

When the gaming state enters the festival mode, there will be more packets falling from the top of the screen. The random determination of the festival mode is carried out in a signage. The effects of the festival mode occur whether it is the base game or the free game and continues for three minutes. Further, the possibility of an overlap symbol appearing is higher than the normal state. There will be more chances of winning a credit or a progressive. Further, when the gaming state enters the festival mode, the progressive amount display screen of the signage, six screens on the side, and the LED of the gaming terminal 10, and the sound change. Namely, the lighting mode of the LED changes from an ordinary lighting to red-based dynamic mode. The sound changes to that gives an impression of the spring festival, and this change is applied to all the gaming terminals. The basic operation of the progressive amount display unit is not changed from that of the ordinary mode; however, a large amount of fireworks are displayed on the background in the festival mode. The six screens display unit shows a gently moving animation on the background during the ordinary state. However, in the festival mode, dragons and Shishimai (Lion dance) appear and a large amount of fireworks are displayed. Further, there is carried out an effect of displayed characters scattering many antique coins.

(Modification of Link Progressive: Effect Process Overview)

In the link progressive shown in FIG. 33, the state of each progressive level (MINI, MINOR, MAJOR, GRAND) is not indicated and is hidden from the player. Only when the player makes his/her pick in a pick game, the state of the progressive level corresponding to the result of the pick game is displayed. However, the link progressive is not limited to this.

For example, the link progressive may be adapted so that the progression status of each progressive level (MINI, MINOR, MAJOR, GRAND) is always displayed and opened to the player. It is possible to hide the progression statuses of a part of the progressive levels (e.g., MINI and MINOR), and display the progression statuses of the rest of the progressive levels (e.g. MAJOR and GRAND). Further, progression of each progressive level may be performed automatically through random determination. It is possible to progress a part of the progressive levels (e.g., MINI and MINOR) through the pick game, and automatically progress the rest of the progressive levels (e.g. MAJOR and GRAND).

Figure 34:
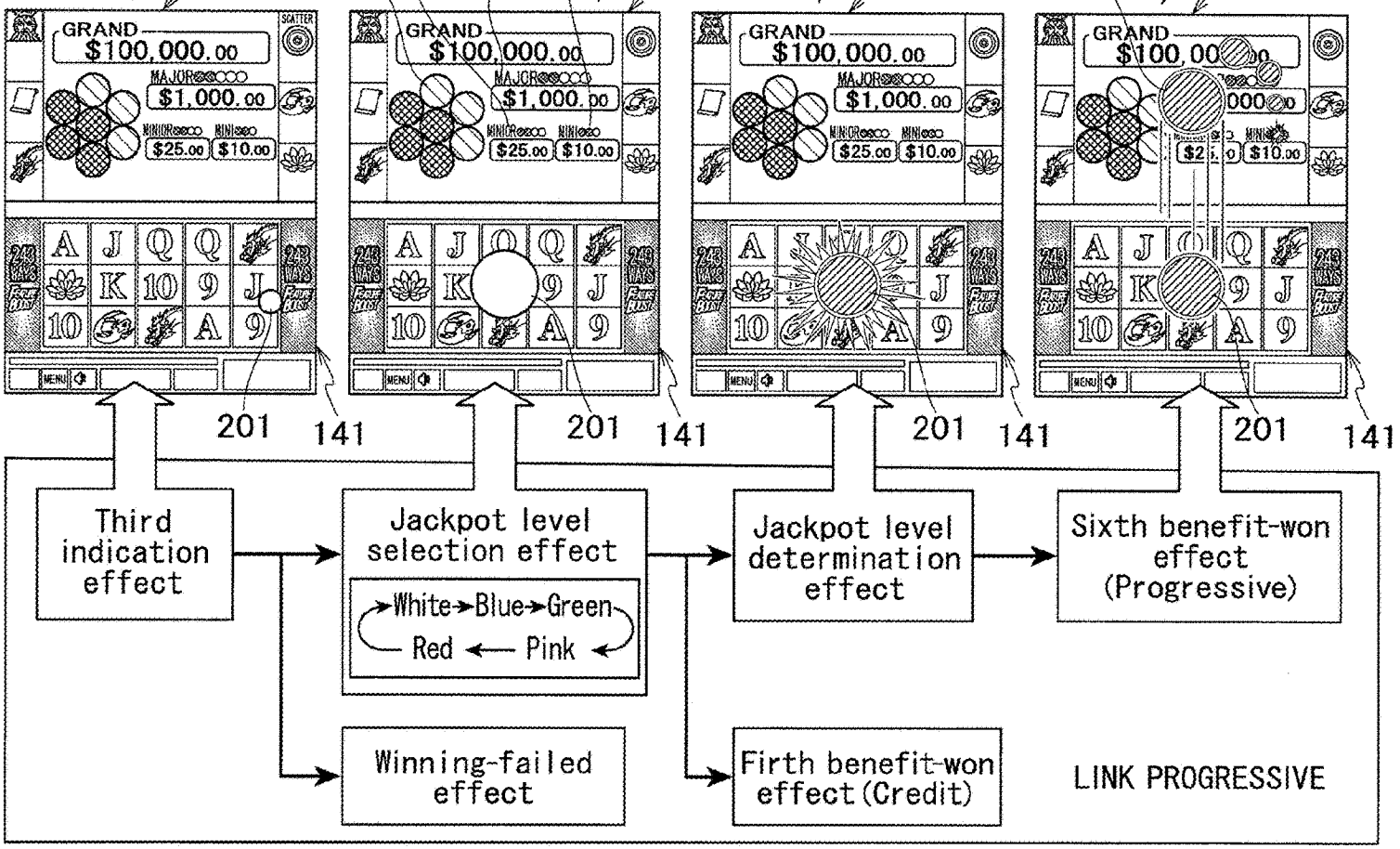
FIG. 34 is a flow of an overall effect process.

To be more specific, each gaming terminal 10 has progressive meters 1311*a*, 1311*b*, 1311*c*, and 1311*d* corresponding to the progressive levels, as shown in FIG. 34. The progressive meter 1311*a* is associated with GRAND level, and indicates the progression status in the form of accumulation of "red" balls. The progressive meter 1311*b* is associated with MAJOR level, and indicates the progression status in the form of accumulation of "pink" balls. The progressive meter 1311*c* is associated with MINOR level, and indicates the progression status in the form of accumulation of "green" balls. The progressive meter 1311*d* is associated with MINI level, and indicates the progression status in the form of accumulation of "blue" balls.

When a transition occurs from the normal game or the free game to the link progressive, the third indication effect is executed. In the third indication effect, an orb symbol 201 stops in front of the reels of the lower image display panel 141. The orb symbol 201 is an overlap symbol. Thus, for example, the orb symbol 201 is displayed, overlapping with the symbol "J". Orb symbol 201 is a spheric light surrounded by a ring. The symbol moves left and right, and up and down for a short period after all the reels stop, thereby causing the player to expect for winning of a progressive.

After the third indication effect, if the result is lose, the winning-failed effect is executed. In the winning-failed effect, the sphere of the orb symbol 201 loses its shining, and crumbles down. At this time the ring of the orb symbol 201 stays where it was.

After the third indication effect, if a progressive is won, a JP level selection effect is executed. In the JP level selection effect, the sphere of the orb symbol 201 moves to the center of the screen. At this time the ring of the orb symbol 201 stays where it was. Then, for a short period, the color of the sphere of the orb symbol 201 sequentially makes quick changes to white, blue, green, pink, and red.

If the color of the sphere of the orb symbol 201 is fixed in white, a fifth benefit-won effect is executed and the credit is displayed. On the other hand, if the color of the sphere is fixed in a color corresponding to any level of the progressive, a visual effect of light emitted from the periphery of the orb symbol 201 (spherical part) is provided, and a JP level determination effect of displaying the credit is executed. After this, the orb symbol 201 rises to the upper image display panel 131 and enters one of the progressive meters 1311*a*, 1311*b*, 1311*c*, and 1311*d* which matches with the color of the sphere of the orb symbol 201, while the size of the symbol is reduced. It should be noted that, in some cases, a plurality of orb symbols 201 may stop in one spin. In such a case, the random determination is carried out for each of the orb symbols 201, and the effects of the link progressive based on the result of the random determination is executed for each of the orb symbols 201.

Thus, the above described other embodiments of the gaming machine 300. In the gaming machine 300, each gaming terminal 1010 and the jackpot controller 1340 are connected to each other and in two-way communication through SEI 1013. The structure however permits only one-way communication between each gaming terminal 1010 and the corresponding media players 1021A, 1021B, 1021C, through X-com substrate 1012. Therefore, the media players 1021A, 1021B, 1021C are not able to transmit any information signal to the associated gaming terminal 1010.

Further, in the gaming machine 300, for example, by transmitting a signal to cause the media players 1021A, 1021A, 1021C to execute an instruction at the timing of starting the effects such as video displayed on the terminal image display panel 16 of the gaming terminal 1010, a effect sound generated by the gaming terminal 1010, and vibration of a control lever 603 for operating a fishing rod (i.e., at a predetermined timing), the image effect on the common display 1700 and effects of the gaming terminal 1010 (the video displayed on the terminal image display panel 16 of the gaming terminal 1010, the effect sound generated by the gaming terminal 1010, and the vibration of the control lever 603 for operating the fishing rod) executed by the media players 1021A, 1021B, 1021C having received the signal are synchronized with each other.

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in this specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal in each step is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A gaming machine, comprising: at least one terminal device which is configured to run a game;

a storage device configured to store information related to the game run in the terminal device;

a benefit awarding device configured to award a benefit to the terminal device; and a controller configured to execute the following processes of (A1) generating a point value in each game play in the terminal device;

(A2) storing in the storage device a first total value resulting from addition involving the point value generated in the process of (A1);

(A3) storing in the storage device a second total value resulting from an addition involving the point value generated in the process (A1);

(A4) subtracting a predetermined point value from the first total value and adding that predetermined point value to the second total value, during a special mode which occurs when a predetermined condition is met; and (A5) the benefit awarding device awarding a benefit to the terminal device, when the second total value reaches a certain value.

2. The gaming machine according to claim 1, wherein, in the process (A1), the game play count is counted up at each play of the game; and in the process of (A4), determining that a predetermined condition is met, when the game play count of the game in the terminal device reaches a certain value.

3. The gaming machine according to claim 1, wherein, the process of (A4) repeats, in each game play, a process of stopping execution of the process of (A1) during the special mode, and subtracting the predetermined point value from the first total value and adding that predetermined point value to the second total value.

4. The gaming machine according to claim 1, wherein, the process of (A4) repeats, in each game play during a predetermined period after the special mode is started, a process of stopping execution of the process of (A1) during the special mode, and subtracting the predetermined point value from the first total value and adding that predetermined point value to the second total value.

5. A gaming machine, comprising: at least one terminal device which is configured to run a game;

a storage device configured to store information related to the game run in the terminal devices;

a benefit awarding device configured to award a benefit to the terminal device; and a controller configured to execute the following processes of (B1) in each game play in the terminal device, counting up the game play count, and then storing the game play count in the storage device;

(B2) generating a point value for each game play in the terminal device;

(B3) storing in the storage device a first total value (for festival mode) resulting from addition involving the point value generated in the process of (B2);

(B4) storing in the storage device a jackpot total value resulting from addition involving the point value generated in the process of (B2);

(B5) storing in the storage device a credit total value resulting from an addition involving the point value generated in the process (B2);

(B6) subtract a predetermined point value from the first total value and adding that predetermined point value to the jackpot total value and to the credit total value, during a special mode which occurs when the game play count in (B1) reaches a certain value; and (B7) the benefit awarding device awarding a first benefit to the terminal device when the jackpot total value reaches a first setting value out of a plurality of setting values including a minimum and a maximum, and awarding a special benefit when the jackpot total value reaches the maximum first setting value;

(B8) the benefit awarding device awarding a second benefit to the terminal device when the credit total value reaches a second setting value out of a plurality of setting values including a minimum and a maximum.

6. The gaming machine according to claim 5, wherein, in the process of (B4), a jackpot level is randomly selected out of a plurality of jackpot levels each associated with the jackpot total value, and the point value generated in the process (B2) are added to the jackpot total value associated with the selected jackpot level.

7. A gaming machine, comprising: at least one terminal device which is configured to run a game;

a storage device configured to store a point value generated in the game in the terminal device and a game play count;

a benefit awarding device configured to award a benefit to the terminal device; and a controller configured to execute the following processes of (C1) storing, in a game play count storage area of the storage device, a total game play count which is incremented in each game play in the terminal device;

(C2) accumulatively storing a portion of the total point value in a first storage area of the storage device, and accumulatively storing the remaining portion of the total point value in a second storage area of the storage device;

(C3) adding the point value stored in the first storage area to the point value stored in the second storage area, when the total game play count stored in the game play count storage area reaches a certain value; and (C4) the benefit awarding device awarding a benefit to the terminal device, when a total point value in the second storage area reaches a certain value.

* * * * *